US008795939B2

(12) United States Patent
Yamamoto et al.

(10) Patent No.: US 8,795,939 B2
(45) Date of Patent: Aug. 5, 2014

(54) TONER, AND DEVELOPER AND IMAGE FORMING APPARATUS USING THE TONER

(71) Applicants: Atsushi Yamamoto, Shizuoka (JP); Shinya Nakayama, Shizuoka (JP); Masahide Yamada, Shizuoka (JP); Hideyuki Santo, Shizuoka (JP); Suzuka Amemori, Shizuoka (JP)

(72) Inventors: Atsushi Yamamoto, Shizuoka (JP); Shinya Nakayama, Shizuoka (JP); Masahide Yamada, Shizuoka (JP); Hideyuki Santo, Shizuoka (JP); Suzuka Amemori, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/632,442

(22) Filed: Oct. 1, 2012

(65) Prior Publication Data

US 2013/0108950 A1 May 2, 2013

(30) Foreign Application Priority Data

Oct. 26, 2011 (JP) ..... 2011-234856

(51) Int. Cl.
*G03G 9/08* (2006.01)

(52) U.S. Cl.
USPC ..... 430/109.4; 430/108.4; 430/109.1

(58) Field of Classification Search
USPC ..... 430/108.4, 109.1, 109.4; 399/252
See application file for complete search history.

(56) References Cited

U.S. PATENT DOCUMENTS

| | | | |
|---|---|---|---|
| 2005/0042534 | A1 | 2/2005 | Tanaka et al. |
| 2011/0123924 | A1 * | 5/2011 | Wosnick et al. ..... 430/124.23 |

FOREIGN PATENT DOCUMENTS

| | | |
|---|---|---|
| CN | 101017352 A | 8/2007 |
| CN | 101154058 A | 4/2008 |
| JP | 2000-242039 | 9/2000 |
| JP | 2006-251718 | 9/2006 |
| JP | 2010-077419 | 4/2010 |
| JP | 2010-102338 | 5/2010 |
| JP | 2010-217849 | 9/2010 |
| JP | 2011-113087 | 6/2011 |
| JP | 2012-042939 | 3/2012 |

OTHER PUBLICATIONS

Office Action issued Mar. 12, 2014, in Chinese Patent Application No. 2012140630, filed Oct. 23, 2012.

* cited by examiner

*Primary Examiner* — Mark A Chapman
(74) *Attorney, Agent, or Firm* — Oblon, Spivak, McClelland, Maier & Neustadt, L.L.P.

(57) ABSTRACT

A toner, including a lactone compound having not less than 14-membered rings; and a resin including a crystalline polyester unit.

13 Claims, 3 Drawing Sheets

TONER, AND DEVELOPER AND IMAGE FORMING APPARATUS USING THE TONER

CROSS-REFERENCE TO RELATED APPLICATIONS

This patent application is based on and claims priority pursuant to 35 U.S.C. §119 to Japanese Patent Application No. 2011-234856 filed on Oct. 26, 2011, in the Japanese Patent Office, the entire disclosure of which is hereby incorporated herein by reference.

FIELD OF THE INVENTION

The present invention relates to a toner, and a developer and an image forming apparatus using the toner.

BACKGROUND OF THE INVENTION

Printers and MFPs using electrophotographic image forming apparatus have been required to consider the environment recently, e.g., trials to decrease power consumption of the printers and MFPs to reduce $CO_2$ and use biomass materials to close to carbon neutral are made. Under the circumstance, a toner for electrophotography is required to lower its fixable temperature, e.g., as a binder resin used in the toner, a crystalline resin instantly melting when heated to be fixed, typified by a crystalline polyester resin is known.

However, toners using a crystalline resin are likely to agglutinate with each other in an image developer, resulting in deterioration of image quality. It is thought this is because the crystalline resin is softer than an amorphous resin used in conventional toners and locally deformed due to mechanical stress.

Further, a toner using the crystalline resin as a main component is easily fell out after fixed when scraped with a pencil. It is thought this is because the crystalline resin has low mechanical strength as well.

Japanese published unexamined application No. 2010-77419 discloses a crystalline resin having a specific storage elastic modulus and a loss elastic modulus for the purpose of providing a particulate resin having good low-temperature fixability and anti-blocking capability. Further, a block resin formed of crystalline polyester and amorphous polyurethane is disclosed as a crystalline resin.

However, toners using the crystalline resin still agglutinate with each other and images after fixed still have low mechanical strength.

Because of these reasons, a need exist for a toner using a crystalline resin, which prevents the toners from agglutinating with each other in an image developer and improves image strength after fixed.

SUMMARY OF THE INVENTION

Accordingly, one object of the present invention to provide a toner using a crystalline resin, which prevents the toners from agglutinating with each other in an image developer and improves image strength after fixed.

Another object of the present invention to provide an image forming apparatus using the toner.

These objects and other objects of the present invention, either individually or collectively, have been satisfied by the discovery of a toner comprising:

a lactone compound having not less than 14-membered rings; and a resin comprising crystalline polyester unit.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
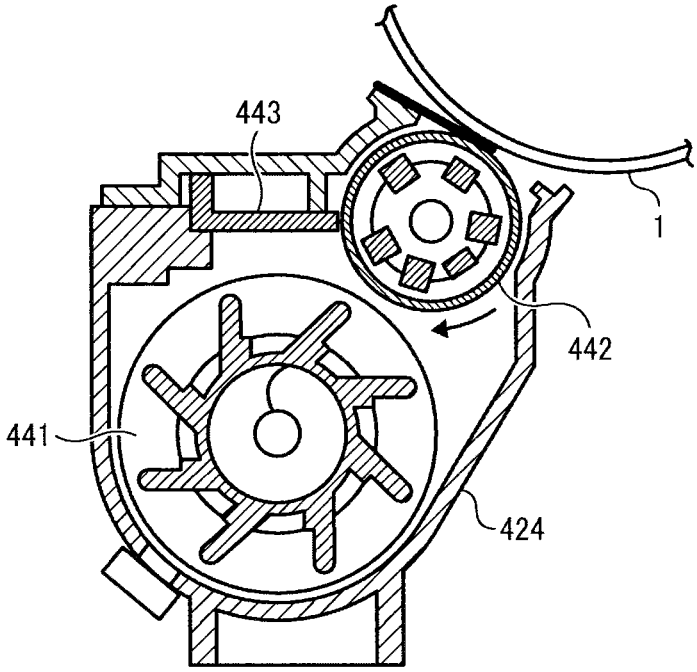
FIG. 1 is a schematic view illustrating an embodiment of a two-component image developer of the image forming apparatus of the present invention.

The present invention provides a toner using a crystalline resin, which prevents the toners from agglutinating with each other in an image developer and improves image strength after fixed.

More particularly, the present invention relates to a toner comprising:

a lactone compound having not less than 14-membered rings; and a resin comprising a crystalline polyester unit.

Toners using a crystalline resin are likely to agglutinate with each other in an image developer and particularly toners using a crystalline resin as a main component form low-strength image after fixed because its is thought the crystalline site has low crystallization, i.e., the amorphous site increases and is easily deformed. Typically, various crystal nucleating agents are considered to control crystallinity of the crystalline site. The crystal nucleating agents needs not only to prevent agglutination of a toner and improve mechanical strength thereof, but also not to impair fixability thereof.

The present inventors discovered a toner including a resin having a crystalline polyester unit as a binder resin prevents agglutination of a toner in an image developer and improves mechanical strength thereof when including a lactone compound having comparatively a large ring structure. It is thought this is because of the following reasons. Many chains of the crystalline polyester unit are formed of alkylene and ester bonds. The lactone compound formed of alkylene and ester bonds has a structure close that of the crystalline polyester. The lactone ring structure has no terminal and has high affinity with a polymer having few terminal structure. Therefore, bleed out on the surface of a toner is difficult to occur. As a result, the lactone compound stays in the resin having a crystalline polyester unit and efficiently functions as a nucleating agent to increase crystallization of the resin and improve the mechanical strength of a toner. Therefore, the agglutination of a toner in an image developer and the image strength are thought improved.

When a long-chain fatty acid, a long-chain alcohol or a long-chain amide is added in a toner, this bleeds out on the surface thereof, resulting in the agglutination thereof. It is thought this is because the structure of the fatty acid, alcohol or acid amide has little affinity with a binder resin. When such materials bleeding out on the surface have a high melting point, they impair wettability of a melted binder resin when fixed on a paper, resulting in fixability of the binder resin.

The lactone compound having not less than 14-membered rings of the present invention preferably has an ester bond on a part of the rings, and specific examples thereof include compounds having the following formula:

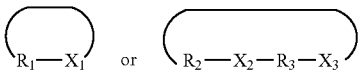

wherein $R_1$, $R_2$ and $R_3$ independently represent a bivalent saturated hydrocarbon linking group; and $X_1$, $X_2$ and $X_3$ independently represent an ester bonding site.

When the ring is small, the ring compound has low melting point and tends to plasticize a toner, which causes the agglutination and deterioration of storage stability. When a ratio of the ester bonds in a compound is relatively large, the ester bonds bleeds out while a toner is prepared or stored, and the surface there of has higher moisture absorbability, resulting in possible deterioration of storage stability particularly at high temperature and high humidity.

The compound preferably has not greater than 22-membered rings, and more preferably not greater than 18-membered rings. When not less than 23-membered rings, the compound is difficult to disperse or dissolve in an organic solvent as a toner material in the process of preparing a toner.

The toner includes the lactone compound in an amount of 0.05 to 5% by weight, preferably from 0.1 to 2% by weight, more preferably from 0.2 to 1% by weight, and further more preferably from 0.4 to 0.7% by weight. When less than 0.05% by weight, the effect of the present invention is difficult to develop. When greater than 5% by weight, the compound is likely to be exposed from a toner, which possibly causes the toner agglutination and impairs fixability of the toner.

The lactone compound having not less than 14-membered rings preferably has the following structure:

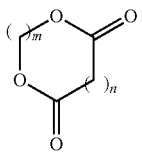

wherein m+n≥10, m≥2 and n≥2.

This structure is close to that of the crystalline polyester unit and has better affinity with a resin having the crystalline polyester unit, and the compound having the structure is uniformly dispersed and functions as a base point of the crystal core Specific examples of the lactone compound include the followings:

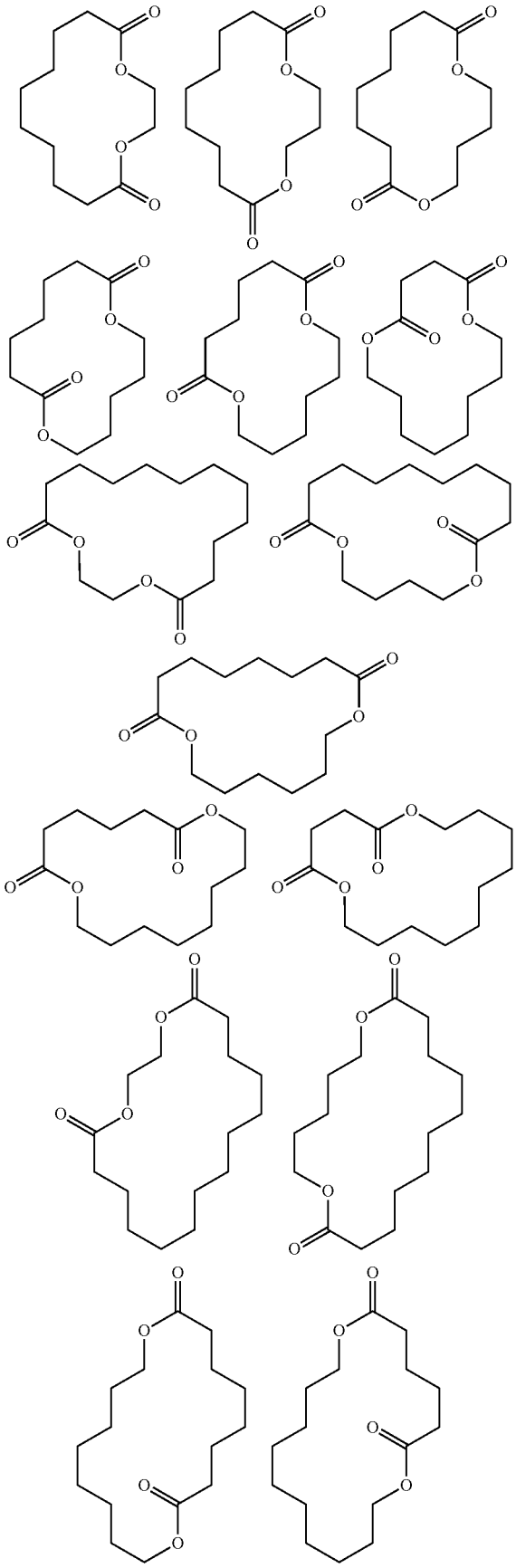

-continued

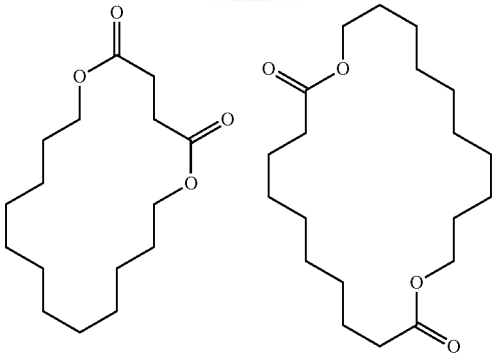

The lactone compound having not less than 14-membered rings is prepared by reacting dicarboxylic acid or dicarboxylic acid dihalide with diol in a dilute solution to synthesize a ring compound. The dilute solution prevents the dicarboxylic acid and the diol from polymerizing. Known esterifying reagents may be used to esterify. Specific examples thereof include 2,4,6-trichlorobenzoic acid chloride, 4-trifluoromethylbenzoic acid anhydride, 3,5-bis(trifluoromethyl)benzoic acid anhydride, 2-methyl-6-nitrobenzoic acid anhydride, 2,6-dimethyl-4-nitrobenzoic acid anhydride, etc. An acid or a basic catalyst suitable for these esterifying reagents is preferably used together.

The lactone compound having not less than 14-membered rings preferably has the same structure as that forming the crystalline polyester unit in terms of affinity with a resin having the crystalline polyester unit.

Monolactone may be used as the lactone compound having not less than 14-membered rings. Specific examples thereof include the followings.

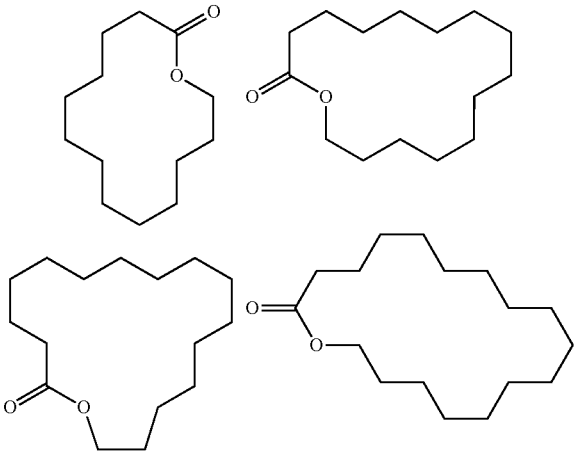

The toner of the present invention includes a binder resin having a crystalline polyester unit. The toner preferably includes the binder resin having a crystalline polyester unit in an amount not less than 50% by weight based on total weight of the binder resin. The binder resin having a crystalline polyester unit and an amorphous resin may be combined, and it is preferable that the binder resin substantially has the crystalline polyester unit as a main component.

The toner of the present invention preferably includes the binder resin having a crystalline polyester unit as a main component. In the present invention, including a binder resin having a crystalline polyester unit as a main component means including a binder resin having a crystalline polyester unit in an amount not less than 50% by weight.

The toner of the present invention preferably includes the binder resin having a crystalline polyester unit n an amount not less than 50% by weight, more preferably not less than 65% by weight, furthermore preferably not less than 80% by weight, and most preferably not less than 95% by weight in terms of maximizing low-temperature fixability and heat-resistant storage stability of the crystalline resin. When less than 50% by weight, the binder resin does not quickly respond to heat to develop viscoelasticity of the toner, and the toner is difficult to have low-temperature fixability and heat-resistant storage stability.

Crystallinity in the present invention is a property of quickly melting with heat having a ratio (melting point/maximum peak temperature of melting heat) of a melting point measured by an elevated flow tester to a maximum peak temperature of melting heat measured by differential scanning calorimeter (DSC) of from 0.80 to 1.55. A resin having this property is the crystalline resin.

Amorphousness is a property of moderately melting with heat having ratio (melting point/maximum peak temperature of melting heat) of a melting point to a maximum peak temperature of melting heat greater than 1.55. A resin having this property is the amorphous resin.

The melting point of a resin or a toner can measured by flow tester CFT-500D from Shimadzu Corp. A load of 1.96 Mpa was applied to 1 g of a sample with a plunger thereof while heated at 6° C./min, and pushed out from a nozzle having a diameter of 1 mm and a length of 1 mm. A temperature at which a half of the sample was flowed out was determined as a softening point.

The maximum peak temperature of melting heat of a resin or a toner can be measured by DSC TA-60WS and DSC-60 from Shimadzu Corp. After melted at 130° C., a sample is cooled at 1.0° C./min from 130 to 70° C., and further cooled at 0.5° C./min from 70 to 10° C. An endothermic and exothermic variation is measured by DSC while heating at 20° C./min to draw a diagram of an endothermic and exothermic amount and a temperature. An endothermic peak temperature is Ta* at from 20 to 100° C. When there are plural endothermic peaks, the peak temperature having the largest endothermic amount is Ta*. Then, after the sample is stored at (Ta*−10)° C. for 6 hrs, the sample is further stored at (Ta*−15)° C. for 6 hrs. Next, after the sample is cooled by DSC at 10° C./min to have a temperature of 0° C., the sample is heated at 20° C./min to measure the endothermic and exothermic variation. The same diagram is drawn, and a temperature correspondent to a maximum peak of the endothermic and exothermic amount is a maximum peak temperature of the melting heat.

As the resin having a crystalline polyester unit, a crystalline polyester resin (an unmodified crystalline polyester resin) formed only of the crystalline polyester unit may be used. However, a modified crystalline polyester resin may be used in terms of improving properties of the resin and controlling a molecular weight thereof, particularly obtaining a polymeric resin. The modified crystalline polyester resin includes crystalline polyester resins having a urethane bond and/or a urea bond in the main chain, and a crystalline polyester resin having a urethane bond in the main chain is preferably used.

The crystalline polyester resin having a urethane bond in the main chain may have scattered urethane bond sites and may be a block polymer having a polyurethane unit in the main chain.

A method of preparing the former resin having a urethane bond in the main chain includes preparing an unmodified crystalline polyester resin having alcohol at the end, and adding an isocyanate compound thereto to be reacted with the alcohol end of the unmodified crystalline polyester resin. Another method of preparing a resin having an isocyanate group at the end with a polyisocyanate compound having two or more isocyanate groups, and elongating or crosslinking the polyisocyanate compound as a prepolymer with a compound having an active hydrogen group may be used.

A method of preparing the former resin includes reacting a polyisocyanate compound with a polyol compound to prepare polyurethane, and reacting the polyurethane with a separately-prepared unmodified crystalline polyester resin having alcohol at the end to prepare a block polymer having a crystalline polyester unit and a urethane unit bond. The polyisocyanate compound, the polyol compound and the unmodified crystalline polyester resin having alcohol at the end may be reacted together to form polyurethane units and bonding among the units at the same time. Even in this method, reaction compositions are controlled such that the end becomes an isocyanate group finally to form a prepolymer, and which may be elongated or crosslinked with a compound having an active hydrogen group.

The crystalline polyester resin having a urea bond in the main chain can be prepared by reacting a crystalline polyester resin having an isocyanate group at the end with an amine compound as a compound having an active hydrogen group. A method of preparing the crystalline polyester resin having a urea bond in the main chain includes preparing an unmodified crystalline polyester resin having alcohol at the end, and adding an isocyanate compound thereto to prepare a crystalline polyester resin having an isocyanate group at the end, and elongating or crosslinking the crystalline polyester resin as a prepolymer with an amine compound having an active hydrogen group.

Specific examples of the crystalline polyester unit include a polycondensed polyester unit synthesized from diol and dicarboxylic acid, a lactone ring-opening polymer, polyhydroxy carboxylic acid, etc. Among these, the polycondensed polyester unit of diol and dicarboxylic acid is preferably used in terms of crystallinity development.

The polyol includes diol and polyols having 3 to 8 or more valences.

Specific examples of the diol include, but are not limited to aliphatic diols such as straight-chain aliphatic diols and branched-chain aliphatic diols; alkylene ether glycols having 4 to 36 carbon atoms; alicyclic diols having 4 to 36 carbon atoms; alkylene oxides (AO) of the alicyclic diols; alkylene oxide adducts of bisphenols; polylactone diols; polybutadiene diols; diols having a carboxyl group; diols having a sulfonic acid group or a sulfamic acid group; diols having other functional groups such as their salts. Among these diols, the branched-chain aliphatic diols having 2 to 36 carbon atoms are preferably used, and the straight-chain aliphatic diols are more preferably used. These can be used alone or in combination.

The diol preferably includes the straight-chain aliphatic diol in an amount not less than 80% by mol, and preferably not less than 90% by mol. When 80% or more, the resin improves in crystallinity, low-temperature fixability and heat-resistant storage stability, and hardness.

Specific examples of the straight-chain aliphatic diols include, but are not limited to ethylene glycol, 1,3-propanediol, 1,4-butanediol, 1,5-pentadiol, 1,6-hexanediol, 1,7-heptanediol, 1,8-octanediol, 1,9-nonanediol, 1,10-decanediol, 1,11-undecanediol, 1,12-dodecanedol, 1,13-tridecanediol, 1,14-tetradecanediol, 1,18-octadecanediol, 1,20-eicosanediol, etc. Among these, ethylene glycol, 1,3-propanediol, 1,4-butanediol, 1,6-hexanediol, 1,9-nonanediol and 1,10-decanediol are preferably used in consideration of obtainability.

Specific examples of the branched-chain aliphatic diols having 2 to 36 carbon atoms include, but are not limited to 1,2-propyleneglycol, butanediol, hexanediol, octanediol, decanediol, dodecanediol, tetradecanediol, neopentylglycol, 2,2,-diethyl-1,3-propanediol, etc.

Specific examples of the alkylene ether glycols having 4 to 36 carbon atoms include, but are not limited to diethyleneglycol, triethyleneglycol, dipropyleneglycol, polyethyleneglycol, polypropyleneglycol, polytetramethyleneetherglycol, etc.

Specific examples of the alicyclic diols having 4 to 36 carbon atoms include, but are not limited to 1,4-cyclohexanedimethanol, hydrogenated bisphenol A, etc.

Specific examples of the alkylene oxides (AO) of the alicyclic diols include, but are not limited to adducts (additional molar number of from 1 to 30) such ethylene oxide (EO), propylene oxide (PO) and butylene oxide (BO).

Specific examples of the bisphenols include, but are not limited to AO (such as EO, PO and BO) adducts (additional molar number of from 2 to 30) of bisphenol A, bisphenol F, bisphenol S, etc.

Specific examples of the polylactone diols include, but are not limited to poly-ϵ-caprolactone diol, etc.

Specific examples of the diols having a carboxyl group include, but are not limited to dialkylolalkanic acids having 6 to 25 carbon atoms such as 2,2-dimethylolpropionic acid (DMPA), 2,2-dimethylolbutanic acid, 2,2-dimethylolheptanic acid and 2,2-dimethyloloctanic acid.

Specific examples of the diols having a sulfonic acid group or a sulfamic acid group include, but are not limited to N,N-bis(2-hydroxyethyl)sulfamic acid, and PO (2 mole) adducts of N,N-bis(2-hydroxyethyl)sulfamic acid, [N,N-bis(2-hydroxyalkyl(C1-C6))sulfamic acid, and AO (EO or PO) (1-6 moles) adducts of [N,N-bis(2-hydroxyalkyl(C1-C6))sulfamic acid; and bis(2-hydroxyethyl)phosphate.

Specific examples of neutralizing bases of these diols having a neutralizing base include, but are not limited to tertiary amines having 3 to 30 carbon atoms such as triethylamine and alkali metals such as a sodium salt.

Among these, alkylene glycol having 2 to 12 carbon atoms, diols having a carboxyl group, AO adducts of bisphenols and their combinations are preferably used.

Specific examples of the polyols having 3 to 8 or more valences include, but are not limited to alkanepolyols and their intramolecular or intermolecular dehydrated products such as glycerin, trimethylolethane, trimethylolpropane, pentaerythritol, sorbitol, sorbitan and polyglycerin; polyaliphatic alcohols having 3 to 36 carbons atoms and 3 to 8 or more valences such as sugars and their derivatives, e.g., sucrose, methylglucoside, etc.; AO (2-30 moles) adducts of trisphenols such as trisphenol PA; AO (2-30 moles) adducts of novolak resins such as phenol novolak and cresol novolak; acrylic polyols such as copolymers of hydroxyethyl(meth) acrylate and other vinyl monomers, etc. Among these, the polyaliphatic alcohols having 3 to 8 or more valences and AO adducts of novolak resins are preferably used, and the AO adducts of novolak resins are more preferably used.

Specific examples of the polycarboxylic acid include dicarboxylic acids and polycarboxylic acids having 3 to 6 or more valences.

Specific examples of the dicarboxylic acids include, but are not limited to aliphatic dicarboxylic acids such as straight-chain aliphatic dicarboxylic acids and branched-chain dicarboxylic acids; and aromatic dicarboxylic acids. Among these, the straight-chain aliphatic dicarboxylic acids are preferably used.

Specific examples of the aliphatic dicarboxylic acids include, but are not limited to alkanedicarboxylic acids having 4 to 36 carbon atoms such as a succinic acid, an adipic acid, a sebacic acid, an azelaic acid, a dodecanedicarboxylic acid, an octadecanedicarboxylic acid and a decylsuccinic acid; alkenylsuccinic acids such as a dodecenylsuccinic acid, a pentadecenylsuccinic acid and an octadecenylsuccinic acid; alkenedicarboxylic acids having 4 to 36 carbon atoms such as a maleic acid, a fumaric acid and a citraconic acid; and alicyclic dicarboxylic acids having 6 to 40 carbon atoms such as a dimer acid (dimeric linoleic acid).

Specific examples of the aromatic dicarboxylic acids include, but are not limited to aromatic dicarboxylic acids having 8 to 36 carbon atoms a such as a phthalic acid, an isophthalic acid, a terephthalic acid, a t-butyl isophthalic acid, a 2,6-naphthalene dicarboxylic acid and a 4,4'-biphenyldicarboxylic acid.

Specific examples of the polycarboxylic acid having 3 to 6 or more valences include aromatic polycarboxylic acids having 9 to 20 carbon atoms such as a trimellitic acid and a pyromellitic acid.

In addition, the above-mentioned acids anhydride or their lower alkyl esters having 1 to 4 carbon atoms such as methyl ester, ethyl ester and isopropyl ester may also be used.

Among these dicarboxylic acids, the aliphatic dicarboxylic acid (preferably the adipic acid, the sebacic acid, the dodecanedicarboxylic acid, the terephthalic acid or the isophthalic acid) is preferably used alone. Copolymers of the dicarboxylic acids and the aromatic dicarboxylic acids (preferably the terephthalic acid, the isophthalic acid, t-butyl isophthalic acid, and their lower alkyl esters) are preferably used as well. The copolymer preferably includes the aromatic dicarboxylic acid in amount not greater than 20 mol %.

Specific examples of the lactone ring-opening polymers include, but are not limited to lactone ring-opening polymers obtained by ring-opening polymerizing lactones, e.g., mono lactones having 3 to 12 carbon atoms (the number of ester groups in a ring is one) such as β-propiolactone, γ-butyrolactone, δ-valerolactone and ϵ-caprolactone with a catalyst such as metal oxides and organic metallic compounds; and lactone ring-opening polymers having a hydroxyl group at the end, obtained by ring-opening polymerizing mono lactones having 3 to 12 carbon atoms with glycol such as ethylene glycol and diethylene as an initiator.

Specific examples of the mono lactones having 3 to 12 carbon atoms include, but are not limited to ϵ-caprolactone, which is preferably used in terms of crystallinity.

Specific examples of marketed products of the lactone ring-opening polymers include high-crystallinity polycaprolactones such as PLACCEL series H1P, H4, H5 and H7 from Daicel Corp.

Specific examples of methods of preparing the polyhydroxy carboxylic acid include, but are not limited to a method of directly dehydrating and condensing polyhydroxy carboxylic acids such as a glycol acid and a lactic acid (L body, D body and racemic acid); and a method of ring-opening polymerizing a cyclic esters having 4 to 12 carbon atoms (2 to 3 ester groups in a ring) equivalent to bi or tri-intermolecular dehydrated and condensed products of hydroxy carboxylic acids such as glycolide and lactide with a catalyst such as metal oxides and organic metallic compounds. The method of ring-opening polymerizing is preferably used in terms of controlling a molecular weight.

L-lactide and D-lactide are preferably used as the cyclic esters in terms of crystallinity. These polyhydroxy carboxylic acids may be modified to have a hydroxyl group or a carboxyl group at the end.

Specific examples of the isocyanate compounds for preparing the resin having scattered urethane bond sites include monoisocyanates, diisocyanates, polyisocyanates having 3 or more valences, etc.

Specific examples of the monoisocyanates include, but are not limited to, monoisocyanate compounds such as phenyl isocyanate, tolylisocyanate, dimethylphenylisocyanate, cyclohexylisocyanate, butylisocyanate, laurylisocyanate, stearylisocyanate and naphtylisocyanate.

Specific examples of the diisocyanate include, but are not limited to aromatic diisocyanates, aliphatic diisocyanates, alicyclic diisocyanates and aromatic aliphatic diisocyanates. Among these, aromatic diisocyanates having 6 to 20 carbon atoms, aliphatic diisocyanates having 2 to 18 carbon atoms, alicyclic diisocyanates having 4 to 15 carbon atoms, aromatic aliphatic diisocyanates having 8 to 15 carbon atoms, their modified products including a urethane group, a carbodiimide group, an allophanate group, a urea group, a biuret group, a uretdione group, a uretimine group, an isocyanurate group, an oxazolidone group, etc., and their combinations. The number of the carbon atoms are those except for that thereof in NCO groups. Isocyanate having 3 or more valences may be combined when necessary.

Specific examples of the aromatic diisocyanates include, but are not limited to 1,3- and/or 1,4-phenylenediisocyanate, 2,4- and/or 2,6-trylenediisocyanate (TDI), crude TDI, 2,4'- and/or 4,4'-diphenylmethanediisocyanate (MDI), crude MDI (such as phosgene compounds of crude diaminophenyl methane (such as condensation products of formaldehyde and an aromatic amine (e.g., aniline) or a mixture including an aromatic amine, and mixtures of diaminodiphenylmethane and a small amount (about 5 to 20% by weight) of tri- or more-functional polyamine); and polyarylpolyisocyanate (PAPI)), 1,5-naphthylenediisocyanate, 4,4',4"-triphenylmethanetriisocyanate, m- and p-isocyanatophenylsulfonylisocyanate, etc.

Specific examples of the aliphatic diisocyanates include, but are not limited to ethylenediisocyanate, tetramethylenediisocyanate, hexamethylenediisocyanate (HDI), dodecamethylenediisocyanate, 1,6,11-undecanetriisocyanate, 2,2,4-trimethylhexamethylenediisocyanate, lysinediisocyanate, 2,6-diisocyanatomethylcaproate, bis(2-isocyanatoethyl)fumarate, bis(2-isocyanatoethyl)carbonate, 2-isocyanatoethyl-2,6-diisocyanatohexanoate, etc.

Specific examples of the alicyclic diisocyanates include, but are not limited to isophoronediisocyanate (IPDI), dicyclohexylmethane-4,4-diisocyanate (hydrogenated MDI), cyclohexylenediisocyanate, methylcyclohexylenediisocyanate (hydrogenated TDI), bis(2-isocyanatoethyl)-4-cyclohexene-1,2-dicarboxylate, 2,5- and 2,6-norbornanediisocyanate, etc.

Specific examples of the aromatic aliphatic diisocyanates include, but are not limited to m- and p-xylylenediisocyanate (XDI), α,α,α',α',-tetramethylxylylenediisocyanate (TMXDI), etc.

Specific examples of the modified products of the diisocyanates include, but are not limited to modified products including a urethane group, a carbodiimide group, an allophanate group, a urea group, a biuret group, a uretdione group, a uretimine group, an isocyanurate group, an oxazolidone group, etc. Specifically, modified MDIs such as urethane-modified MDI, carbodiimide-modified MDI and trihydrocarvylphosphate-modified MDI; urethane-modified TDI such as a prepolymer including isocyanate; and their mixtures such as a mixture of the modified MDI and the urethane-modified TDI can be used.

Among these diisocyanates, aromatic diisocyanates having 6 to 15 carbon atoms, aliphatic diisocyanates having 4 to 12 carbon atoms, alicyclic diisocyanates having 4 to 15 carbon atoms are preferably used (the number of the carbon atoms are those except for that thereof in NCO groups), and TDI, MDI, HDI, hydrogenated MDI and IPDI are more preferably used.

The polyurethane unit is synthesized from diol or polyol having 3 to 8 or more valences and diisocyanate or polyisocyanate having 3 or more valences. Particularly, the polyurethane unit synthesized from diol and diisocyanate is preferably used.

Specific examples of the diol and polyol having 3 to 8 or more valences include those of the above-mentioned polyester unit.

Specific examples of the polyisocyanate include diisocyanate and polyisocyanate having 3 or more valences.

Specific examples of the compound having an active hydrogen group include, but are not limited to compounds having a hydroxyl group (an alcoholic hydroxyl group and a phenolic hydroxylic group), an amino group, a carboxyl group or a mercapto group as the active hydrogen group when functional group reactable with an active hydrogen group is an isocyanate group, and water. Among these, the compounds having an amino group, i.e., amines and water capable of decreasing sub-materials when particles are granulated in an aqueous medium are preferably used.

The hydroxyl group, the amino group, the carboxyl group and the mercapto group elongate or crosslink with an isocyanate group to form a urethane or a urea bond. Water reacts with an isocyanate group to form an amino group, and the amino group elongates or crosslinks with the unreacted isocyanate group.

Specific examples of the amines include, but are not limited to phenylene diamine, diethyltoluene diamine, 4,4'-diaminodiphenyl methane, 4,4'-diamino-3,3'-dimethyldicyclohexyl methane, diaminocyclohexane, isophoronediamine, ethylene diamine, tetramethylene diamine, hexamethylene diamine, diethylene triamine, triethylene tetramine, ethanol amine, hydroxyethyl aniline, aminoethyl mercaptan, aminopropyl mercaptan, amino propionic acid, amino caproic acid, etc. In addition, ketimine compounds, oxazoline compounds, etc, which are prepared by blocking the amino groups of the amines with ketones such as acetone, methyl ethyl ketone and methyl isobutyl ketone can also be used.

The toner of the present invention preferably includes two or more resins having a crystalline polyester unit. The two include resins having a different molecular weight each other, resins modified or not, and resins different from each other. They are preferably a first resin having a crystalline polyester unit and a second resin having a crystalline polyester unit and a weight-average molecular weight larger than that of the first resin having a crystalline polyester unit. When the first resin having a crystalline polyester unit has low-temperature fixability and the second resin having a crystalline polyester unit has hot offset resistance, the resultant toner is formed of functionally-separated resins and has a wider range of fixable temperature. The second resin having a crystalline polyester unit is preferably formed by elongating the modified polyester resin having an isocyanate group because of being capable of forming a crystalline resin having higher molecular weight in a binder resin. The second resin having a crystalline polyester unit is preferably a modified crystalline polyester resin formed by modifying the first resin having a crystalline polyester unit to a crystalline resin having a functional group such as an isocyanate group reactable with an active hydrogen group and reacting this with a compound having an active hydrogen group as a prepolymer because of being uniformly dispersed in the binder resin, and the resultant toner has better low-temperature fixability and hot offset resistance.

The first resin having a crystalline polyester unit preferably has a weight-average molecular weight of from 2,000 to 100,000, more preferably from 5,000 to 60,000, and most preferably from 8,000 to 30,000 in terms of fixability. When less than 2,000, the hot offset resistance tends to deteriorate. When larger than 100,000, the low-temperature fixability tends to deteriorate.

The second resin having a crystalline polyester unit preferably has a weight-average molecular weight larger than that of the first resin having a crystalline polyester unit, and of from 10,000 to 1,000,000, more preferably from 30,000 to 1,000,000, and most preferably from 50,000 to 500,000 in terms of offset resistance. When less than 10,000, the hot offset resistance tends to deteriorate. When larger than 1,000,000, the low-temperature fixability tends to deteriorate.

A difference of weight-average molecular weight between the first resin having a crystalline polyester unit and the second resin having a crystalline polyester unit is preferably not less than 5,000, and more preferably not less than 10,000. When less than 5,000, the toner tends to have narrower fixable width.

A content ratio (A/B) of the first resin having a crystalline polyester unit (A) to the second resin having a crystalline polyester unit (B) of from 95/5 to 70/30. When (A) has a content ratio larger than this, the hot offset resistance of the toner tends to deteriorate. When (B) has a content ratio larger than this, the low-temperature fixability thereof tends to deteriorate.

In the present invention, the weight-average molecular weight of a resin is measured by gel permeation chromatography (GPC) under the following conditions.

Apparatus (example): HLC-8120 from Tosoh Corp.

Column (example): 2 rolls of TSK GEL GMH6 from Tosoh Corp.

Measurement temperature: 40° C.

Sample solution: THF solution including 0.25% by weight

Solution quantity: 100 μL

Detector: Refraction index detector

Standard material: TSK standard POLYSTYRENE from Tosoh Corp. 12 points (molecular weight 500, 1050, 2800, 5970, 9100, 18100, 37900, 96400, 190000, 355000, 1090000 and 2890000)

Specific examples of the amorphous resins include, but are not limited to a monomer of styrene and its derivative such as polystyrene, poly-p-styrene and polyvinyltoluene; a styrene copolymer such as styrene-p-chlorostyrene copolymer, styrene-propylene copolymer, styrene-vinyltoluene copolymer, styrene-methyl acrylate copolymer, styrene-ethyl acrylate copolymer, styrene-methacrylic acid copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ether copolymer, styrene-vinyl methyl ketone copolymer, styrene-butadiene copolymer, styrene-isoprene copolymer, styrene-maleate copolymer; poly(methyl methacrylate), poly(butyl methacrylate), polyvinylchloride, polyvinyl acetate, polyethylene, polyester, polyurethane, epoxy resin, polyvinyl butyral, poly (acrylic acid), rosin, modified rosin, terpene resin, phenolic resin, aliphatic or aromatic hydrocarbon resin, aromatic petroleum resin etc., and their modified resins to have a functional group reactable with an active hydrogen group. These can be used alone or in combination.

Specific examples of the colorants for use in the present invention include any known dyes and pigments such as carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red FSR, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone, etc. These can be used alone or in combination.

Specific examples of color of the colorants include, but are not limited to black, magenta, cyan, yellow, etc. These can be used alone or in combination.

Specific examples of black color colorants include carbon blacks (C.I. Pigment Black 7) such as furnace black, lamp black, acetylene black and channel black; metals such as copper, iron (C.I. Pigment Black 11) and titanium oxide; and an organic pigment such as aniline black (C.I. Pigment Black 1), etc.

Specific examples of magenta color colorants include C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 48:1, 49, 50, 51, 52, 53, 53:1, 54, 55, 57, 57:1, 58, 60, 63, 64, 68, 81, 83, 87, 88, 89, 90, 112, 114, 122, 123, 163, 177, 179, 202, 206, 207, 209 and 211; C.I. Pigment Violet 19; and C.I. Vat Red 1, 2, 10, 13, 15, 23, 29 and 35.

Specific examples of cyan color colorants include C.I. Pigment Blue 2, 3, 15, 15:1, 15:2, 15:3, 15:4, 14:6, 15, 17 and 60; C.I. Vat Blue 6; C.I. Acid Blue 45; copper phthalocyanine pigment in which the phthalocyanine skeleton substituted with 1 to 5 phthalimide methyl groups; and Green 7 and Green 36.

Specific examples of yellow color colorants include C.I. Pigment Yellow O-16, 1, 2, 3, 4, 5, 6, 7, 10, 11, 12, 13, 14, 15, 16, 17, 23, 55, 65, 73, 74, 83, 97, 110, 151, 154 and 180; C.I. Vat yellow 1, 3 and 20; and Orange 36.

The toner preferably includes the colorant in an amount of from 1 to 15% by weight, and more preferably from 3 to 10% by weight. When less than 1% by weight, the toner deteriorates in colorability. When greater than 15% by weight, the colorant is not sufficiently dispersed in the toner, resulting in deterioration of the colorability and chargeability.

The colorant may be combined with a resin to be used as a masterbatch. Specific examples of the resin include, but are not limited to styrene polymers and substituted styrene polymers, styrene copolymers, a polymethyl methacrylate resin, a polybutylmethacrylate resin, a polyvinyl chloride resin, a polyvinyl acetate resin, a polyethylene resin, a polypropylene resin, a polyester resin, an epoxy resin, an epoxy polyol resin, a polyurethane resin, a polyamide resin, a polyvinyl butyral resin, an acrylic resin, rosin, modified rosin, a terpene resin, an aliphatic or an alicyclic hydrocarbon resin, an aromatic petroleum resin, chlorinated paraffin, paraffin, etc. These resins are used alone or in combination.

Specific examples of the styrene polymers and substituted styrene polymers include a polyester resin, a polystyrene resin, a poly-p-chlorostyrene resin and a polyvinyltoluene resin. Specific examples of the styrene copolymers include styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers, etc.

The masterbatch can be prepared by mixing and kneading a resin and a colorant upon application of high shearing stress thereto. In this case, an organic solvent is preferably used to increase interactions between the colorant and the resin. In addition, flushing methods, wherein an aqueous paste including a colorant is mixed with a resin solution of an organic solvent to transfer the colorant to the resin solution and then the aqueous liquid and organic solvent are separated and removed, is preferably used because the resultant wet cake of the colorant can be used as it is. A three-roll mill is preferably used for kneading the mixture upon application of high shearing stress.

The toner of the present invention may include other components beside the binder resin and the colorant when necessary, such as a release agent, a charge controlling agent, an external additive, a fluidity improver, a cleanability improver and a magnetic material.

The release agent is not particularly limited, and known release agents can be used. Specific examples thereof include waxes including a carbonyl group, polyolefin waxes, long-chain hydrocarbons, etc. Among these, waxes including a carbonyl group and long-chain hydrocarbons are preferably used.

Specific examples of the waxes including a carbonyl group include ester polyalkanates such as a carnauba wax, a montan wax, trimethylolpropanetribehenate, pentaerythritoltetrabehenate, pentaerythritoldiacetatedibehenate, glycerinetribehenate, and 1,18-octadecanedioldistearate; polyalkanolesters such as tristearyltrimelliticate and distearylmaleate; amide polyalkanates such as ethylenediaminedibehenylamide; polyalkylamides such as tristearylamidetrimelliticate; and dialkylketones such as distearylketone. Among these waxes including a carbonyl group, the ester polyalkanates are preferably used.

Specific examples of the polyolefin waxes include polyethylene waxes and polypropylene waxes.

Specific examples of the long chain hydrocarbons include paraffin waxes and sasol waxes.

The release agent preferably has a melting point of from 40 to 160° C., more preferably from 50 to 120° C., and most preferably from 60 to 90° C. When less than 40° C., the resultant toner occasionally deteriorates in heat-resistant storage stability. When higher than 160° C., the resultant toner occasionally deteriorates in cold offset resistance. The melting point of the release agent can be measured by a differential scanning calorimeter DSC-210 from Seiko Instruments Inc., in which a sample is heated up to 200° C., cooled to 0° C. at 10° C./min, and heated at 10° C./min to determine a maximum peak temperature of the melting heat as the melting point.

The release agent preferably has a melting viscosity of from 5 to 1,000 cps, and more preferably from 10 to 100 cps at a temperature 20° C. higher than the melting point. When less than 5 cps, the resultant toner occasionally deteriorates in releasability. When greater than 1,000 cps, the resultant toner occasionally deteriorates in hot offset resistance and low-temperature fixability.

The toner preferably includes the release agent in an amount of from 0 to 40%, and more preferably from 3 to 30% by weight. When greater than 40% by weight, the resultant toner occasionally deteriorates in fluidity.

The toner of the present invention may include a charge controlling agent when necessary. The charge controlling agents is not particularly limited, and known charge controlling agents can be used. However, colorless or whity agents are preferably used because colored agents occasionally charge the color tone of the resultant toner. Specific examples thereof include triphenylmethane dyes, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid and its derivatives, etc. These can be used alone or in combination.

Specific examples of the marketed products of the charge controlling agents include BONTRON P-51 (quaternary ammonium salt), E-82 (metal complex of oxynaphthoic acid), E-84 (metal complex of salicylic acid), and E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc.

The charge controlling agent may be melted and kneaded with the masterbatch, and dissolved or dispersed, dissolved or dispersed in an organic solvent with other toner materials, or fixed on the surface of a toner after prepared.

The content of the charge controlling agent is determined depending on the species of the binder resin used, whether or not an additive is added and toner manufacturing method (such as dispersion method) used, and is not particularly limited. However, the content of the charge controlling agent is typically from 0.1 to 10 parts by weight, and preferably from 0.2 to 5 parts by weight, per 100 parts by weight of the binder resin included in the toner. When the content is too high, the toner has too large charge quantity, and thereby the electrostatic force of a developing roller attracting the toner increases, resulting in deterioration of the fluidity of the toner and decrease of the image density of toner images.

Specific examples of the external additives include Specific examples of the external additives include particulate silica, hydrophobized particulate silica, fatty acid metallic salts such as zinc stearate and alumina stearate; metal oxides or hydrophobized metal oxides such as particulate titania, alumina, tin oxide and antimony oxide; fluoropolymers, etc. Among these external additives, the hydrophobized particulate silica, hydrophobized particulate titania and hydrophobized particulate alumina are preferably used.

Specific examples of the particulate silica include HDK H 2000, HDK H 2000/4, HDK H 2050EP and HVK21 from Hoechst AG; and R972, R974, RX200, RY200, R202, R805 and R812 from Nippon Aerosil Co. Specific examples of the particulate titania include P-25 from Nippon Aerosil Co.; ST-30 and STT-65C-S from Titan Kogyo K.K.; TAF-140 from Fuji Titanium Industry Co., Ltd.; MT150W, MT-500B and MT-600b from Tayca Corp., etc. Specific examples of the particulate hydrophobized titanium oxide include T-805 from Nippon Aerosil Co.; STT-30A and STT-65S-S from Titan Kogyo K. K.; TAF-500T and TAF-1500T from Fuji Titanium Industry Co., Ltd.; MT-100S and MT100T from Tayca Corp.; IT-S from Ishihara Sangyo Kaisha Ltd., etc.

To prepare the particulate hydrophobized silica, titania or alumina, a hydrophilic particulate material is subjected to silane coupling agents such as methyltrimethoxy silane, methyltriethoxy silane and octylmethoxy silane.

An inorganic particulate material optionally subjected to a silicone oil upon application of heat is preferably used as well.

Specific examples of the silicone oil include dimethyl silicone oil, methylphenyl silicone oil, chlorphenyl silicone oil, methylhydrogen silicone oil, alkyl modified silicone oil, fluorine modified silicone oil, polyether modified silicone oil, alcohol modified silicone oil, amino modified silicone oil, epoxy modified silicone oil, epoxy-polyether modified silicone oil, phenol modified silicone oil, carboxyl modified silicone oil, mercapto modified silicone oil, acryl modified silicone oil, methacryl modified silicone oil, α-methylstyrene modified silicone oil, etc.

Specific examples of the inorganic particulate material include silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc. Particularly, the silica and titanium dioxide are preferably used.

The toner preferably includes the external additives in an amount of from 0.1 to 5% by weight and more preferably from 0.3 to 3% by weight.

The inorganic particulate material preferably has an average primary particle diameter not greater than 100 nm, and more preferably of from 3 to 70 nm. When less than 3 nm, the inorganic particulate material is buried in the toner. When greater than 100 nm, the surface of a photoreceptor is damaged.

As the external additive, the inorganic particulate material and a hydrophobized inorganic particulate material can be used together. It is preferable to externally include at least one hydrophobized inorganic particulate material having an average primary particle diameter of from 1 to 100 nm, and more preferably from 5 to 70 nm. Further, it is more preferable to include at least one hydrophobized inorganic particulate material having an average primary particle diameter not greater than 20 nm and an inorganic particulate material having an average primary particle diameter not less than 30 nm. The external additive preferably has a specific surface area of from 20 to 500 $m^2/g$ when measured by a BET method.

Specific examples of surface treatment agents for external additives including the oxidized particulate materials include silane coupling agents such as dialkyldihalogenated silane, trialkylhalogenated silane, alkyltrihalogenated silane and hexaalkyldisilazane; silylation agents; silane coupling agents having a fluorinated alkyl group; organic titanate coupling agents; aluminum coupling agents; silicone oil; and silicone varnish.

Particulate resins can be used together as the external additives. Specific examples thereof include polystyrene formed by a soap-free emulsifying polymerization, a suspension polymerization or a dispersing polymerization; ester-methacrylate or esteracrylate copolymers; polycondensed particulate materials such as silicone resins, benzoguanamine resins and nylon; and particulate polymers of thermosetting resins. The particulate resins combined with the other external additives improve chargeability of the resultant toner, and reduce a reversely-charged toner to decrease background fouling. The toner preferably includes the particulate resin in an amount of from 0.01 to 5% by weight, and more preferably from 0.1 to 2.0% by weight.

The fluidity improver improves hydrophobicity of the toner by surface-treatment and prevents deterioration of fluidity and chargeability thereof even at high humidity. Specific examples there of include silane coupling agents, sililating agents, silane coupling agents having an alkyl fluoride group, organic titanate coupling agents, aluminium coupling agents silicone oils and modified silicone oils.

The cleanability improver is used to easily remove a toner remaining on a photoreceptor and a first transferer after transferred. Specific examples thereof include fatty acid metallic salts such as zinc stearate, calcium stearate and stearic acid; and particulate polymers prepared by a soap-free emulsifying polymerization method such as particulate polymethylmethacrylate and particulate polystyrene. The particulate polymers comparatively have a narrow particle diameter distribution and preferably have a volume-average particle diameter of from 0.01 to 1 μm.

Specific examples of the magnetic material include, but are not limited to iron powder, magnetite, ferrite, etc.

The toner of the present invention by a solution suspension method granulating a toner material liquid in an aqueous medium, and an aggregation method aggregating and melting s toner material including at least ac crystalline resin in an aqueous medium. The former method is preferably used in terms of resin uniformity.

Toner materials such as a colorant, a resin and a release agent are dispersed or dissolved in an organic solvent to prepare a toner material liquid. The colorant, the resin and the release agent may separately be dispersed or dissolved in an organic solvent and mixed.

The organic solvent is preferably a volatile solvent having a boiling point less than 100° C. because of being easily removed after a toner particle is formed. Specific examples of the organic solvents include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, methyl ethyl ketone and methyl isobutyl ketone. These can be used alone or in combination. Particularly, aromatic solvents such as the toluene and xylene and halogenated hydrocarbons such as the methylene chloride, 1,2-dichloroethane, chloroform and carbon tetrachloride. A content of the organic solvent is typically from 0 to 300 parts by weight, preferably from 0 to 100 parts by weight, and more preferably from 25 to 70 parts by weight per 100 parts by weight of the toner materials.

Next, the toner material liquid is emulsified in an aqueous medium in the presence of a surfactant and a particulate resin.

The aqueous medium may include water alone and mixtures of water with a solvent which can be mixed with water. Specific examples of the solvent include alcohols such as methanol, isopropanol and ethylene glycol; dimethylformamide; tetrahydrofuran; cellosolves such as methyl cellosolve; and lower ketones such as acetone and methyl ethyl ketone.

The content of the water medium is typically from 50 to 2,000 parts by weight, and preferably from 100 to 1,000 parts by weight per 100 parts by weight of the toner constituent liquid. When the content is less than 50 parts by weight, the toner constituent liquid is not well dispersed and a toner particle having a predetermined particle diameter cannot be formed. When the content is greater than 2,000 parts by weight, the production cost increases.

A dispersant such as a surfactant and particulate resin is optionally included in the aqueous medium to improve the dispersion therein.

Specific examples of the surfactants include anionic surfactants such as alkylbenzene sulfonic acid salts, α-olefin sulfonic acid salts, and phosphoric acid salts; cationic surfactants such as amine salts (e.g., alkyl amine salts, aminoalcohol fatty acid derivatives, polyamine fatty acid derivatives and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic surfactants such as fatty acid amide derivatives, polyhydric alcohol derivatives; and ampholytic surfactants such as alanine, dodecyldi(aminoethyl)glycin, di(octylaminoethyle)glycin, and N-alkyl-N,N-dimethylammonium betaine.

A surfactant having a fluoroalkyl group can prepare a dispersion having good dispersibility even when a small amount of the surfactant is used. Specific examples of anionic surfactants having a fluoroalkyl group include fluoroalkyl carboxylic acids having from 2 to 10 carbon atoms and their metal salts, disodium perfluorooctanesulfonylglutamate, sodium 3-{omega-fluoroalkyl(C6-C11)oxy}-1-alkyl(C3-C4) sulfonate, sodium-{omega-fluoroalkanoyl(C6-C8)-N-ethylamino}-1-propanesulfonate, fluoroalkyl(C11-C20) carboxylic acids and their metal salts, perfluoroalkylcarboxylic acids and their metal salts, perfluoroalkyl(C4-C12)sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl(C6-C10)-N-ethylsulfonylglycin, monoperfluoroalkyl(C6-C16) ethylphosphates, etc.

Specific examples of the marketed products of such surfactants having a fluoroalkyl group include SURFLON S-111, S-112 and S-113, which are manufactured by Asahi Glass Co., Ltd.; FRORARD FC-93, FC-95, FC-98 and FC-129, which are manufactured by Sumitomo 3M Ltd.; UNIDYNE DS-101 and DS-102, which are manufactured by Daikin Industries, Ltd.; MEGAFACE F-110, F-120, F-113, F-191, F-812 and F-833 which are manufactured by Dainippon Ink and Chemicals, Inc.; ECTOP EF-102, 103, 104, 105, 112, 123A, 306A, 501, 201 and 204, which are manufactured by Tohchem Products Co., Ltd.; FUTARGENT F-100 and F150 manufactured by Neos; etc.

Specific examples of cationic surfactants include primary, secondary and tertiary aliphatic amines having a fluoroalkyl group, aliphatic quaternary ammonium salts such as erfluoroalkyl(C6-C10)sulfoneamidepropyltrimethylammonium salts, benzalkonium salts, benzetonium chloride, pyridinium salts, imidazolinium salts, etc. Specific examples of the marketed products thereof include SURFLON S-121 (from Asahi Glass Co., Ltd.); FRORARD FC-135 (from Sumitomo 3M Ltd.); UNIDYNE DS-202 (from Daikin Industries, Ltd.); MEGAFACE F-150 and F-824 (from Dainippon Ink and Chemicals, Inc.); ECTOP EF-132 (from Tohchem Products Co., Ltd.); FUTARGENT F-300 (from Neos); etc.

Specific examples of the particulate resin include any thermoplastic and thermosetting resins capable of forming a dispersion element such as vinyl resins, a polyurethane resin, an epoxy resin, a polyester resin, a polyamide resin, a polyimide resin, silicon resins, a phenol resin, a melamine resin, a urea resin, an aniline resin, an ionomer resin, a polycarbonate resin, etc. These resins can be used alone or in combination.

Among these resins, the vinyl resins, the polyurethane resin, the epoxy resin, the polyester resin and their combinations are preferably used in terms of forming an aqueous dispersion of microscopic spherical particulate resins. Specific examples of the vinyl resins include homopolymerized or copolymerized polymers such as styrene-(metha)esteracrylate resins, styrene-butadiene copolymers, (metha) acrylic acid-esteracrylate polymers, styrene-acrylonitrile copolymers, styrene-maleic acid anhydride copolymers and styrene-(metha)acrylic acid copolymers. The particulate resin preferably has an average particle diameter of from 5 to 200 nm, and more preferably from 20 to 300 nm. Inorganic compound dispersants such as tricalcium phosphate, calcium carbonate, titanium oxide, colloidal silica and hydroxyapatite, etc. can be used as well.

A polymeric protective colloid can be used as a dispersant with the particulate resin and the inorganic compound dispersants. Specific examples thereof include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethylene imine). In addition, polymers such as polyoxyalkylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose and hydroxypropyl cellulose, can also be used as the polymeric protective colloid.

The dispersion method is not particularly limited, and low speed shearing methods, high-speed shearing methods, friction methods, high-pressure jet methods, ultrasonic methods, etc. can be used. Among these methods, high-speed shearing methods are preferably used because particles having a particle diameter of from 2 to 20 μm can be easily prepared. When a high-speed shearing type dispersion machine is used, the rotation speed is not particularly limited, but the rotation speed is typically from 1,000 to 30,000 rpm, and preferably from 5,000 to 20,000 rpm. The dispersion time is not also particularly limited, but is typically from 0.1 to 5 min. The temperature in the dispersion process is typically from 0 to 150° C. (under pressure), and preferably from 40 to 98° C.

In order to remove the organic solvent from the aqueous (resin) dispersion of the toner material liquid, the aqueous dispersion is gradually heated while stirred to completely vapor the organic solvent therefrom.

Alternatively, the aqueous (resin) dispersion is sprayed in a dried atmosphere while stirred to remove the organic solvent in the droplet. Or, the aqueous (resin) dispersion is depressurized while stirred to vapor the organic solvent therefrom. These two methods can be used together with the first method.

The air, nitrogen gas, carbonate gas and combustion gas, particularly heated to have a temperature higher than its boiling point us typically used as the dried atmosphere the aqueous (resin) dispersion is sprayed in. A spray drier, a belt drier or a rotary kiln is used to vapor the solvent in s short time.

When a modified resin having an isocyanate group at the end is used, there may be an aging process to promote elongation or crosslinking reaction of the isocyanate. The aging time is typically from 10 min to 40 hrs, and preferably from 2 to 24 hrs. The reaction temperature is typically from 0 to 40° C., and preferably from 15 to 30° C.

The resin includes side materials such as a surfactant and a dispersant, and is washed to remove these as well as a high-polarity material present on the surface of the particulate resin. This prevents methanol wettability of the toner.

The high-polarity material includes a surfactant, a particulate resin, a dispersant, etc., which are thought to partly adhere or adsorb to the surface of the resin or partly penetrate inside thereof. These are effectively removed when heated with an acid or an alkaline. Particularly when the high-polarity material is ionic, ionic dissociation is preferably made. An alkaline is preferably used to remove particulate resins having an anionic surfactant, a carboxylic group or a sulfonic acid group, and an acid is preferably used to remove dispersants such as calcium phosphate. The alkaline preferably has 9 to 13 pH, more preferably from 9.5 to 12 pH, and furthermore preferably from 10 to 11 pH. When less than 9 pH, the resin is not effectively washed. When greater than 13 pH, the resin is possibly hydrolyzed.

The maximum heating temperature is less than a melting point of the crystalline resin. When greater than the melting point, the resin molecule executes free thermal motion and is vulnerable to alkaline attack, resulting in decrease of molecular weight and deterioration of heat-resistant storage stability. The minimum heating temperature is preferably not less than 30° C., more preferably not less than 40° C., and furthermore preferably not less than 45° C. When less than 30° C., the resin is not effectively washed. The resin is heated for at least 30 min, preferably not less than 2 hrs, more preferably not less than 5 hrs, and furthermore preferably not less 10 hrs. When less than 30 min, the resin is not effectively washed. This is thought to be effective to remove a polymeric high-polarity material.

The above-mentioned process may be performed after washing with ion-exchanged water, or before the aging process after washing with ion-exchanged water.

After the above-mentioned process, washing with ion-exchanged water is preferably performed and with an acid. This is thought to close even a small amount if remaining acidic functional group with proton.

The resin is washed by a centrifugal separation method, a reduced pressure filtration method or a filter press method, but the methods are not particularly limited thereto. A resin cake is obtained in any methods. When the resin is not fully washed at a time, the cake may be dispersed again in an aqueous solvent and any of the methods is repeated. When the reduced pressure filtration method or the filter press method is used, the aqueous solvent may be penetrated through the cake to wash way a side material the resin holds in. The aqueous solvent is water or a mixed solvent including water and alcohol such as methanol and ethanol. Water is preferably used in consideration of cost and environmental load such as effluent treatment.

The washed resin holds in the aqueous medium much, and is dried to remove the aqueous medium to obtain only the resin. Dryers such as a spray drier, a vacuum freeze drier, a reduced pressure drier, a static shelf drier, a fluidized-bed drier, a rotary drier and a stirring drier can be used. The resin is preferably dried to have a moisture content less than 1%. The resin after dried has flocculation, and which is loosened by a jet mill, a Henschel Mixer, a super mixer, a coffee mill, Oster blender, a food processor, etc.

Heterogeneous particles such as colorant particles, charge controlling particles and fluidizing particles can be mixed with the toner powder after drying. Release of the heterogeneous particles from composite particles can be prevented by giving a mechanical stress to a mixed powder to fix and fuse them on a surface of the composite particles.

Specific methods include a method of applying an impact force on the mixture with a blade rotating at high-speed, a method of putting a mixture in a high-speed stream and accelerating the mixture such that particles thereof collide with each other or composite particles thereof collide with a collision board, etc. Specific examples of the apparatus include an ONG MILL from Hosokawa Micron Corp., a modified I-type mill having a lower pulverizing air pressure from Nippon Pneumatic Mfg. Co., Ltd., a hybridization system from Nara Machinery Co., Ltd., a Kryptron System from Kawasaki Heavy Industries, Ltd., an automatic mortar, etc.

When a toner is prepared by a condensation method, at least a resin having at least a crystalline polyester unit and a lactone compound having not less than 14-membered rings, and a colorant, a release agent and a resin having no crystalline polyester unit when necessary are dispersed in an aqueous medium to be condensed and melted to adhere to each other. The lactone compound having not less than 14-membered rings may be dispersed alone, or with the resin having a crystalline polyester unit and/or the resin having no crystalline polyester unit in an aqueous medium.

The developer of the present invention includes the toner and other components such as a carrier when necessary.

The developer may be a one-component developer or a two-component developer, and the two-component developer is preferably used to improve longevity thereof when used in high-speed printers in compliance with the recent information process speed.

The one-component developer has less variation of particle diameter, no filming over a developing roller, and no melting and adhering to a toner layer thickness regulator such as a blade even when fed and consumed, and has good and stable developability and image productivity even when stirred for long periods. Further, the two-component developer has less variation of particle diameter even when fed and consumed for long periods, and has good and stable developability even when stirred for long periods.

The one-component developer may be a magnetic toner or a non-magnetic toner.

The carrier is not particularly limited, and can be selected in accordance with the purpose, however, preferably includes a core material and a resin layer coating the core material.

The core material is not particularly limited, and can be selected from known materials such as Mn—Sr materials and Mn—Mg materials having 50 to 90 emu/g; and highly magnetized materials such as iron powders having not less than 100 emu/g and magnetite having 75 to 120 emu/g for image density. In addition, light magnetized materials such as Cu—Zn materials having 30 to 80 emu/g are preferably used to decrease a stress to a photoreceptor having toner ears for high-quality images. These can be used alone or in combination.

The core material preferably has a volume-average particle diameter (D50) of from 10 to 200 μm, and more preferably from 40 to 100 μm. When less than 10 μm, a magnetization per particle is so low that the carrier scatters. When larger than 200 μm, a specific surface area lowers and the toner occasionally scatters, and a solid image of a full-color image occasionally has poor reproducibility.

The resin coating the core material is not particularly limited, and can be selected in accordance with the purpose. Specific examples of the resin include amino resins, polyvinyl resins, polystyrene resins, halogenated olefin resins, polyester resins, polycarbonate resins, polyethylene resins, polyvinyl fluoride resins, polyvinylidene fluoride resins, polytrifluoroethylene resins, polyhexafluoropropylene resins, vinylidenefluoride-acrylate copolymers, vinylidenefluoride-vinylfluoride copolymers, fluoroterpolymers of tetrafluoroethylene, vinylidenefluoride and other monomers including no fluorine atom, and silicone resins. These can be used alone or in combination. Among these, silicone resins are preferably used.

Specific examples of the silicone resin include, but are not limited to, any known silicone resins such as straight silicones formed only of organosiloxane bonds and silicones modified with a resin such as an alkyd resin, a polyester resin, an epoxy resin, an acrylic resin and a urethane resin.

Specific examples of marketed products of the straight silicones include, but are not limited to, KR271, KR255 and KR152 from Shin-Etsu Chemical Co., Ltd; and SR2400, SR2406 and SR2410 from Dow Corning Toray Silicone Co., Ltd. The straight silicone resins can be used alone, and a combination with other constituents crosslinking therewith or charge controlling constituents can also be used.

Specific examples of the modified silicones include, but are not limited to, KR206 (alkyd-modified), KR5208 (acrylic-modified), EX1001N (epoxy-modified) and KR305 (urethane-modified) from Shin-Etsu Chemical Co., Ltd; and SR2115 (epoxy-modified) and SR2110 (alkyd-modified) from Dow Corning Toray Silicone Co., Ltd.

The silicone resin can be used alone, and with crosslinkable components and charge controlling agents as well.

The resin layer may include an electroconductive powder when necessary, and specific examples thereof include metallic powders, carbon black, titanium oxide, tin oxide, zinc oxide, etc. The electroconductive powder preferably has an average particle diameter not greater than 1 μm. When greater than 1 μm, it is occasionally difficult to control electrical resistance.

The resin layer can be formed by preparing a coating liquid including a solvent and, e.g., the silicone resin; uniformly coating the liquid on the surface of the core material by a known coating method; and drying the liquid and burning the surface thereof. The coating method includes dip coating methods, spray coating methods, brush coating method, etc.

Specific examples of the solvent include, but are not limited to, toluene, xylene, methyl ethyl ketone, methyl isobutyl ketone, cellosolve butyl acetate, etc.

Specific examples of the burning methods include, but are not limited to, externally heating methods or internally heating methods using fixed electric ovens, fluidized electric ovens, rotary electric ovens, burner ovens, microwaves, etc.

The carrier preferably includes the resin layer in an amount of from 0.01 to 5.0% by weight. When less than 0.01% by weight, a uniform resin layer cannot be formed on the core material. When greater than 5.0% by weight, the resin layer becomes so thick that carrier particles granulate one another and uniform carrier particles cannot be formed.

The content of the carrier in a two-component developer is not particularly limited, and can be selected in accordance with the purpose. The developer preferably includes the carrier in an amount of from 90 to 98% by weight, and more preferably from 93 to 97% by weight.

The two-component developer preferably includes the toner in an amount of from 1 to 10.0 parts by weight per 100 parts by weight of the carrier.

The image forming apparatus of the present invention includes at least an electrostatic latent image bearer, an electrostatic latent image former, an image developer, a transferer and a fixer; more preferably a cleaner; and further includes other means such as a discharger, a recycler and a controller when necessary.

The image developer is a means of developing an electrostatic latent image with a toner to form a visual image, and the toner is the toner of the present invention.

The charger and an irradiator are occasionally combined to be called the electrostatic latent image former. The image developer includes a fixed magnetic field generator and a rotatable developer bearer bearing the toner of the present invention.

A material, shape, structure, size, etc. of the electrostatic latent image bearer are not particularly limited, and can be selected according to the purposes. The electrostatic latent image bearer has the shape of a drum, a sheet or an endless belt. The electrostatic latent image bearer may have a single-layered structure or a multilayered structure. The electrostatic latent image bearer may be formed of inorganic materials such as amorphous silicon, serene, CdS and ZnO or organic materials such as polysilane and phthalopolymethine.

The charger charges the surface of the electrostatic latent image bearer.

The charger is not particularly limited, provided it can uniformly charge the surface of the electrostatic latent image bearer when applied with a voltage. The charger is broadly classified into (1) a contact charger contacting the electrostatic latent image bearer to charge and (2) a non-contact charger not contacting the electrostatic latent image bearer to charge.

Specific examples of (1) the contact charger include an electroconductive or a semiconductive charging roller, a magnetic bush, a fur brush, a film, a rubber blades, etc. The charging roller generates much less ozone than a corona discharger, and the electrostatic latent image bearer can stably be used even when repeatedly used, and which effectively prevents deterioration of image quality.

Specific examples of (2) the non-contact charger include a non-contact charger and a needle electrode device using corona discharge; a solid discharge element; and an electroconductive or a semiconductive charging roller having a microscopic gap between the electrostatic latent image bearer and the roller.

The irradiator irradiates the charged surface of the electrostatic latent image bearer to form an electrostatic latent image.

The irradiator is not particularly limited, provided that the irradiator can irradiate the surface of the electrostatic latent image bearer with the imagewise light, and specific examples thereof include reprographic optical irradiators, rod lens array irradiators, laser optical irradiators and a liquid crystal shutter optical irradiators. In the present invention, a backside irradiation method irradiating the surface of the electrostatic latent image bearer through the backside thereof may be used.

The image developer is not particularly limited, and can be selected from known image developers, provided that the image developer can develop with the toner of the present invention. For example, an image developer containing the developer of the present invention and being capable of feeding the toner to the electrostatic latent image in contact or not in contact therewith is preferably used.

The image developer is a means of developing an electrostatic latent image with the toner to form a visual image, and the toner is the toner of the present invention.

The image developer may use dry or wet developing method, and may be single-color image developer or multicolor image developer.

The image developer preferably includes a stirrer stirring the developer of the present invention to be frictionally charged, a fixed magnetic field generator, and a rotatable developer bearer bearing a developer including the toner on the surface.

In the image developer, the toner and the carrier are mixed and stirred, and the toner is charged and held on the surface of the rotatable magnet roller in the shape of an ear to form a magnetic brush. Since the magnet roller is located close to the electrostatic latent image bearer, a part of the toner is electrically attracted to the surface thereof. Consequently, the electrostatic latent image is developed with the toner to form a visual image thereon.

FIG. 1 is a schematic view illustrating a two-component image developer. In the two-component image developer, a two-component developer is stirred and fed by a screw 441 to a developing sleeve 442 as a developer bearer. The two-component developer fed to the developing sleeve 442 is regulated by a doctor blade 443 as a layer thickness regulation member, and an amount of the developer fed is controlled by a doctor gap between the doctor blade 443 and the developing sleeve 442. When the doctor gap is too small, the amount of the developer is too small to produce images having sufficient image density. When too large, the developer is excessively fed, resulting in carrier adherence on the electrostatic latent image bearer. The developing sleeve 442 includes a magnet as a magnetic field generator forming a magnetic field to form ears of the developer on the circumferential surface. Along a magnetic line in normal direction from the magnet, ears of the developer are formed on the developing sleeve 442 to form a magnetic brush.

The developing sleeve 442 and the electrostatic latent image bearer are located close to each other across a specific distance (developing gap), and a developing area is formed at a part where they face each other. The developing sleeve 442 is formed of a cylindrical non-magnetic materials such as aluminum, brass, stainless and electroconductive resin, and is rotatable by an unillustrated rotor. The magnetic brush is transferred to the developing area by rotation of the developing sleeve 442. The developing sleeve 442 is applied with a developing bias by an unillustrated electrical source for development, and a toner on the magnetic brush is separated by a developing electric field formed between the developing sleeve 442 and the electrostatic latent image bearer and transferred onto an electrostatic latent thereon. The developing bias may be overlapped with an AC bias.

The developing gap preferably has a size 5 to 30 times as large as a particle diameter of the developer, and when the developer has a particle diameter of 50 μm, the developing gap preferably has a size of from 0.25 to 1.5 mm. When larger than this, images having desirable image density are occasionally difficult to produce.

The doctor gap preferably has a size equivalent to or a little larger than that of the developing gap. When the electrostatic latent image bearer is a drum-shaped photoreceptor, a diameter and a linear speed of the drum and those of the developing sleeve 442 depend on copy speed and a size of the apparatus. A ratio of the linear speed of the sleeve to that of the drum is preferably not less than 1.1 to produce images having required image density. A toner adherence amount may be detected by a sensor from an optical reflectance after developed to control process conditions.

The transferer is a means of transferring the visual image onto a recording medium.

The transferer is broadly classified into a direct transferer directly transferring a visual image on the electrostatic latent image bearer onto a recording medium and an indirect transferer first transferring a visual image onto an intermediate transferer and secondly transferring the visual image onto a recording medium therefrom. Any of the transferers are not particularly limited, and can be selected from known transferers.

The fixer is a means of fixing a visual image on a recording medium.

The fixer is not particularly limited, and can be selected according the purposes. A fixer having a fixing member and a heat source heating the fixing member is preferably used. The fixing member is not particularly limited, provided it can form a nip. Specific examples thereof include a combination of an endless belt and a roller, and a roller and a roller. The combination of an endless belt and a roller, and a heating method from the surface of the fixing member by induction heating are preferably used in terms of shortening warm-up and energy saving.

The fixer is broadly classified into (1) an inner heating fixer including at least a roller or a belt, heating from a surface not contacting a toner, and heating and pressing an image transferred onto a recording medium to be fixed thereon; and (2) an outer heating fixer including at least a roller or a belt, heating from a surface contacting a toner, and heating and pressing an image transferred onto a recording medium to be fixed thereon. They can be combined.

Specific examples of (1) the inner heating fixer include fixers having a fixing member including a heater. The heater includes heat sources such as a heater and a halogen lamp.

Specific examples of (2) the outer heating fixer include fixers having at least one fixing member at least a part of the surface of which is heated by a heater. The heater is not particularly limited, and can be selected according to the purposes. Specific examples thereof include an electromagnetic induction heater. The electromagnetic induction heater is not particularly limited, and can be selected according to the purposes. The electromagnetic induction heater preferably has a means of generating a magnetic field and a means of heating by electromagnetic induction. Specific example of the means of heating by electromagnetic induction include a means formed of an induction coil located close to the fixing member such as a heat roller, a shielding layer including the induction coil, and an insulative layer located opposite to the shielding layer. The heat roller is preferably a magnetic heat pipe. The induction coil is preferably located so as to cover at least a semi-cylindrical part if the heat roller at an opposite side of a contact point between the heat roller and the fixing member such as a pressure roller and an endless belt.

The process cartridge of the present invention includes at least an electrostatic latent image bearer and an image developer, and further includes other means such as a charger, an irradiator, a transferer, a cleaner and a discharger when necessary.

The image developer is a means of developing an electrostatic latent image borne on the electrostatic latent image bearer with a toner to form a visual image, and the toner is the toner of the present invention.

The image developer includes at least a toner container containing the toner of the present invention and a toner bearer bearing and feeding the toner contained in the toner container. The mage developer may further include a regulation member regulating a thickness of the toner borne by the toner bearer. The image developer preferably includes a two-component developer and a developer bearer bearing and feeding the two-component developer contained in the developer container. Specifically, any of the image developers mentioned above can preferably be used.

In addition, the above-mentioned charger, irradiator, transferer, cleaner and discharger can selectively be used.

The process cartridge of the present invention is detachably equipped with various electrophotographic image forming apparatuses such as facsimiles and printers, and preferably equipped with the electrophotographic image forming apparatus of the present invention.

Figure 2:
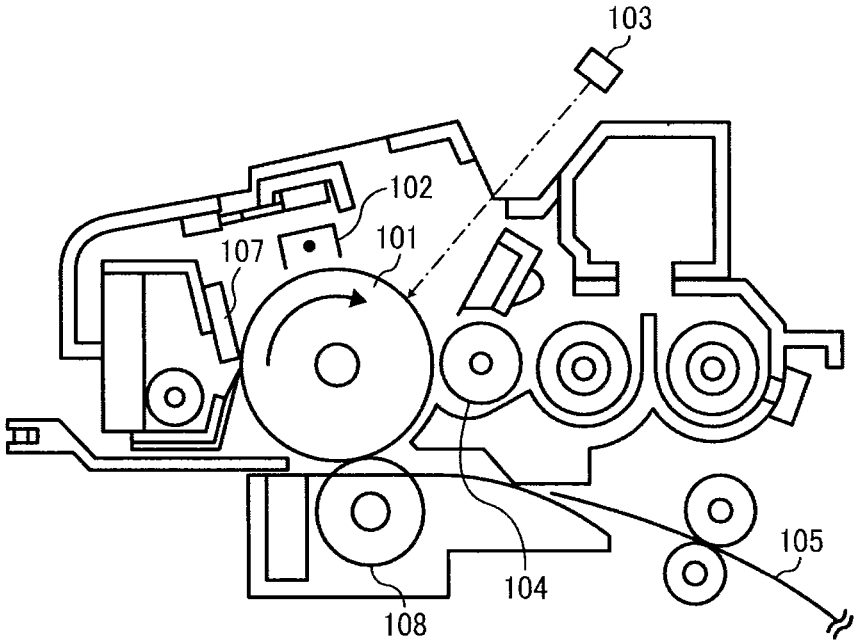
FIG. 2 is a schematic view illustrating an embodiment of the process cartridge of the present invention.
Figure 3:
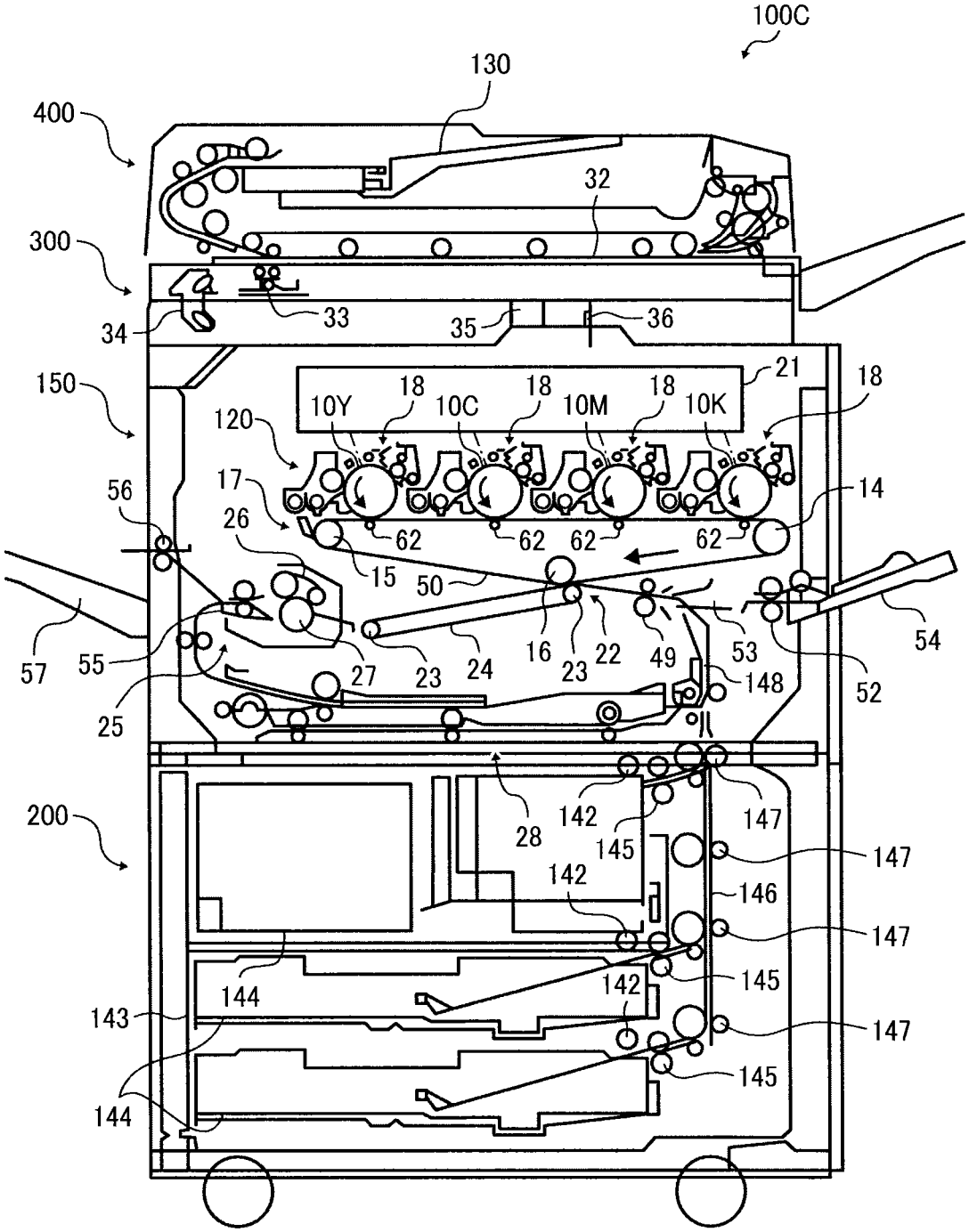
FIG. 3 is a schematic view illustrating an embodiment of the tandem-type image forming apparatus of the present invention.

The process cartridge includes, as FIG. 2 shows, an electrostatic latent image bearer 101, a charger 102, an image developer 104, a transferer 108, a cleaner 107 and other means when necessary. In FIG. 3, numeral 103 represents an irradiation and 105 represents a recording medium.

Next, an image forming process by the process cartridge in FIG. 2 is explained. The electrostatic latent image bearer 101 is charged by the charger 102 and irradiated (103) by an unillustrated irradiator while rotating in an arrow direction to form an electrostatic latent image on the surface thereof. The electrostatic latent image is developed by the image developer 104 with a toner to form a toner image. The toner image is transferred by the transferer 108 onto the recording medium 105, and printed out. Then, the surface of the electrostatic latent image bearer is cleaned by the cleaner 107 after the toner image is transferred, further discharged by an unillustrated discharger, and the above-mentioned operation is repeated.

FIG. 3 is a schematic view illustrating an embodiment of the image forming apparatus for use in the present invention. The image forming apparatus 100C therein is a tandem full-color image forming apparatus including a duplicator 150, a paper feeding table 200, a scanner 300 and an automatic document feeder (ADF) 400.

An intermediate transfer belt 50 located at the center of the duplicator 150 is an endless belt suspended by three suspension rollers 14, 15 and 16 and rotatable in an arrow direction. Near the suspension roller 15, an intermediate transferer cleaner 17 is located to remove a residual toner on an intermediate transfer belt 50 after an image is transferred. Yellow, cyan, magenta and black image forming units 120Y, 120C, 120M and 120K are parallely located facing the intermediate transfer belt 50 suspended by the rollers 14 and 15 and along travel direction thereof. An irradiator 21 is located near the image forming unit 120. On the opposite side of image forming unit 120 across the intermediate transfer belt 50, a second transfer belt 24 is located. The second transfer belt 24 is an endless belt suspended by a pair of rollers 23. A recording paper fed on the second transfer belt 24 and the intermediate transferer belt 50 contact each other between the rollers 16 and 23. Near the second transfer belt 24, a fixer 25 including a fixing belt 26 which is an endless belt suspended by a pair of rollers and a pressure roller 27 pressed by the fixing belt 26. A sheet reverser 28 reversing the sheet to form an image on both sides thereof is located near the second transfer belt 24 and the fixer 25, Next, full-color image formation using the image forming apparatus 100*c* will be explained. A color original is set on a table 130 of the automatic document feeder (ADF) 400 to make a copy, or on a contact glass 32 of a scanner 300 and pressed with the ADF 400. When a start switch (not shown) is put on, a first scanner 33 and a second scanner 34 scans the original after the original set on the table 30 of the ADF 400 is fed onto the contact glass 32 of the scanner 300, or immediately when the original set thereon. The first scanner 33 emits light to the original and reflects reflected light therefrom to a second scanner 34. The second scanner 34 further reflects the reflected light to a reading sensor 36 through an imaging lens 35 to read the color original (color image) as image information of black, yellow, magenta and cyan.

Figure 4:
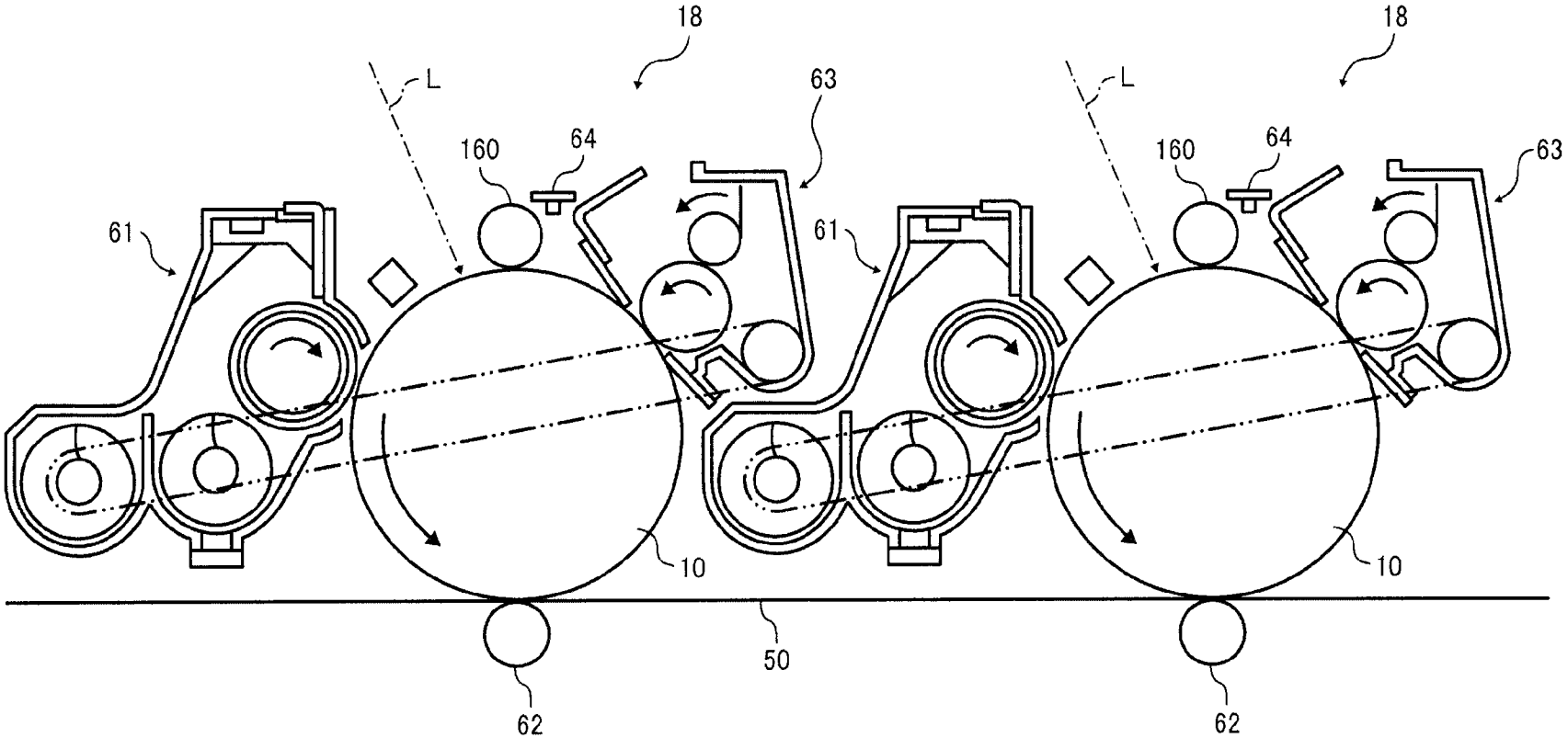
FIG. 4 is an amplified view illustrating each image forming element in FIG. 3.

The black, yellow, magenta and cyan image information are transmitted to each image forming unit 120 to form a black toner image, a yellow toner image, a magenta toner image and a cyan toner image. Namely, each of the image forming units 120 includes, as shown in FIG. 4, a photoreceptor 10, i.e., a photoreceptor for black 10K, a photoreceptor for yellow 10Y, a photoreceptor for magenta 10M and a photoreceptor for cyan 10C; a charging roller 160 uniformly charging the photoreceptor 10; an irradiator irradiating the photoreceptor with imagewise light (L in FIG. 4) based on each color image information to form an electrostatic latent image thereon; an image developer 61 developing the electrostatic latent image with each color toner, i.e., a black toner, a yellow toner, a magenta toner and a cyan toner to form a toner image thereon; a transfer charger 62 transferring the toner image onto the intermediate transfer belt 50; a photoreceptor cleaner 63; and a discharger 64.

Each of the color toner image formed by each of the image forming units 120 is sequentially (first) transferred onto the intermediate transfer belt 50 travelling while suspended by the rollers 14, 15 and 16 and overlapped thereon to form a combined toner image.

On the other hand, when start switch (not shown) is put on, one of paper feeding rollers 142 of the paper feeding table 200 is selectively rotated to take a sheet out of one of multiple-stage paper cassettes 144 in a paper bank 143. A separation roller 145*a* separates sheets one by one and feed the sheet into a paper feeding route 146, and a feeding roller 147 feeds the sheet into a paper feeding route 148 to be stopped against a registration roller 49. Alternatively, a paper feeding roller 142 is rotated to take a sheet out of a manual feeding tray 51, and a separation roller 145 separates sheets one by one and feed the sheet into a paper feeding route 53 to be stopped against the registration roller 49. The registration roller 49 is typically earthed, and may be biased to remove a paper dust from the sheet. Then, in timing with a synthesized full-color image on the intermediate transfer belt 50, the registration roller 49 is rotated to feed the sheet between the intermediate transfer belt 50 and the second transfer belt 24, and the second transferer transfers (second transfer) the full-color image onto the sheet. The intermediate transfer belt 50 after transferring an image is cleaned by the intermediate transferer cleaner 17 to remove a residual toner thereon after the image is transferred.

The sheet the full-color image is transferred on is fed by the second transfer belt 24 to the fixer 25. The fixer 25 fixes the image thereon upon application of heat and pressure, and the sheet is discharged by a discharge roller 56 onto a catch tray 57 through a switch-over click 55. Alternatively, the switch-over click 55 feeds the sheet into the sheet reverser 28 reversing the sheet to a transfer position again to form an image on the backside of the sheet, and then the sheet is discharged by the discharge roller 56 onto the catch tray 57.

EXAMPLES

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

<Synthesis of Lactone Compound 1>

In a reaction vessel including a stirrer, a reflux pipe and two drip funnels, 9.6 parts of 2-methyl-6-nitrobenzoate anhydride and 0.015 parts of N,N-dimethylaminopyridine were dissolved in 150 parts of tetrahydrofuran in a nitrogen atmosphere.

A solution in which 2.4 parts of sebacic acid were dissolved in 500 ml of tetrahydrofuran was placed in the first drip funnel and a solution in which 1.2 parts of hexamethylene glycol were dissolved in 500 ml of tetrahydrofuran was placed in the second drip funnel. After the solutions were dripped for 8 hrs at the same speed while stirred by the stirrer, the mixture was further stirred for 1 hr.

Next, 500 ml of a saturated aqueous solution of sodium hydrogen carbonate were added to the mixture and mixed therein. Then, an organic layer was removed, washed with ion-exchanged water, and dried.

The dried material was analyzed by a gas chromatograph mass spectrometer to find the material includes a [lactone compound 1] having the following formula as a main component.

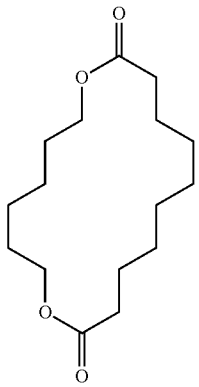

<Synthesis of Lactone Compound 2>

In a reaction vessel including a stirrer, a reflux pipe and two drip funnels, 11.0 parts of 2-methyl-6-nitrobenzoate anhydride and 0.017 parts of N,N-dimethylaminopyridine were dissolved in 150 parts of tetrahydrofuran in a nitrogen atmosphere.

A solution in which 2.8 parts of sebacic acid were dissolved in 500 ml of tetrahydrofuran was placed in the first drip funnel and a solution in which 0.9 parts of ethylene glycol were dissolved in 500 ml of tetrahydrofuran was placed in the second drip funnel. After the solutions were dripped for 8 hrs at the same speed while stirred by the stirrer, the mixture was further stirred for 1 hr.

Next, 500 ml of a saturated aqueous solution of sodium hydrogen carbonate were added to the mixture and mixed therein. Then, an organic layer was removed, washed with ion-exchanged water, and dried.

The dried material was analyzed by a gas chromatograph mass spectrometer to find the material includes a [lactone compound 2] having the following formula as a main component.

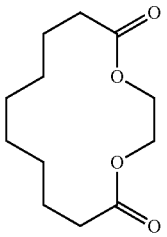

<Synthesis of Lactone Compound 3>

In a reaction vessel including a stirrer, a reflux pipe and two drip funnels, 11.0 parts of 2-methyl-6-nitrobenzoate anhydride and 0.017 parts of N,N-dimethylaminopyridine were dissolved in 150 parts of tetrahydrofuran in a nitrogen atmosphere.

A solution in which 2.0 parts of adipic acid were dissolved in 500 ml of tetrahydrofuran was placed in the first drip funnel and a solution in which 1.5 parts of hexamethylene glycol were dissolved in 500 ml of tetrahydrofuran was placed in the second drip funnel. After the solutions were dripped for 8 hrs at the same speed while stirred by the stirrer, the mixture was further stirred for 1 hr.

Next, 500 ml of a saturated aqueous solution of sodium hydrogen carbonate were added to the mixture and mixed therein. Then, an organic layer was removed, washed with ion-exchanged water, and dried.

The dried material was analyzed by a gas chromatograph mass spectrometer to find the material includes a [lactone compound 3] having the following formula as a main component.

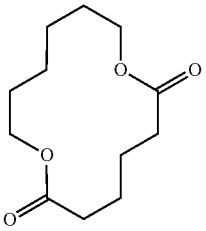

<Synthesis of Lactone Compound 4>

In a reaction vessel including a stirrer, a reflux pipe and two drip funnels, 10.4 parts of 2-methyl-6-nitrobenzoate anhydride and 0.016 parts of N,N-dimethylaminopyridine were dissolved in 150 parts of tetrahydrofuran in a nitrogen atmosphere.

A solution in which 2.6 parts of sebacic acid were dissolved in 500 ml of tetrahydrofuran was placed in the first drip funnel and a solution in which 1.2 parts of butylene glycol were dissolved in 500 ml of tetrahydrofuran was placed in the second drip funnel. After the solutions were dripped for 8 hrs at the same speed while stirred by the stirrer, the mixture was further stirred for 1 hr.

Next, 500 ml of a saturated aqueous solution of sodium hydrogen carbonate were added to the mixture and mixed therein. Then, an organic layer was removed, washed with ion-exchanged water, and dried.

The dried material was analyzed by a gas chromatograph mass spectrometer to find the material includes a [lactone compound 4] having the following formula as a main component.

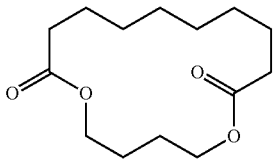

<Synthesis of Lactone Compound 5>

In a reaction vessel including a stirrer, a reflux pipe and two drip funnels, 11.0 parts of 2-methyl-6-nitrobenzoate anhydride and 0.017 parts of N,N-dimethylaminopyridine were dissolved in 150 parts of tetrahydrofuran in a nitrogen atmosphere.

A solution in which 2.8 parts of sebacic acid were dissolved in 500 ml of tetrahydrofuran was placed in the first drip funnel and a solution in which 1.1 parts of 2-propylene glycol were dissolved in 500 ml of tetrahydrofuran was placed in the second drip funnel. After the solutions were dripped for 8 hrs at the same speed while stirred by the stirrer, the mixture was further stirred for 1 hr.

Next, 500 ml of a saturated aqueous solution of sodium hydrogen carbonate were added to the mixture and mixed therein. Then, an organic layer was removed, washed with ion-exchanged water, and dried.

The dried material was analyzed by a gas chromatograph mass spectrometer to find the material includes a [lactone compound 5] having the following formula as a main component.

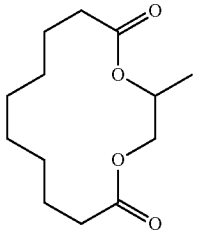

<Synthesis of Lactone Compound 7>

In a reaction vessel including a stirrer, a reflux pipe and two drip funnels, 7.2 parts of 2-methyl-6-nitrobenzoate anhydride and 0.011 parts of N,N-dimethylaminopyridine were dissolved in 150 parts of tetrahydrofuran in a nitrogen atmosphere.

A solution in which 2.0 parts of sebacic acid were dissolved in 500 ml of tetrahydrofuran was placed in the first drip funnel and a solution in which 1.7 parts of 1, 10-decanediol were dissolved in 500 ml of tetrahydrofuran was placed in the second drip funnel. After the solutions were dripped for 8 hrs at the same speed while stirred by the stirrer, the mixture was further stirred for 1 hr.

Next, 500 ml of a saturated aqueous solution of sodium hydrogen carbonate were added to the mixture and mixed therein. Then, an organic layer was removed, washed with ion-exchanged water, and dried.

The dried material was analyzed by a gas chromatograph mass spectrometer to find the material includes a [lactone compound 7] having the following formula as a main component.

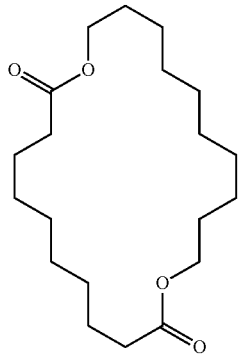

<Crystalline Resin 1>

In a reaction vessel including a cooling pipe, a stirrer and a nitrogen inlet pipe, 283 parts of sebacic acid, 215 parts of 1,6-hexanediol and 1 part of titaniumdihydroxybis(triethanolaminate) as a condensation catalyst were reacted for 8 hrs under a nitrogen stream at 180° C. while produced water is removed. Next, the reactant was reacted for 4 hrs while gradually heated to have a temperature of 220° C. under a nitrogen stream and produced water and 1,6-hexanediol were removed. The reactant was further reacted under reduced pressure by 5 to 20 mm Hg until the reactant had a number-average molecular weight of 5,200 to prepare a base resin. Two hundred (200) parts of ethylacetate were added to 250 parts of the base resin to be diluted at 60° C. to prepare a base resin solution.

Meanwhile, in a reaction vessel including a cooling pipe, a stirrer and a nitrogen inlet pipe, 7.5 parts of 4,4-diphenylmethanediisocyanate (MDI), 75 parts of ethylacetate, and further the base resin solution were placed to be reacted at 80° C. for 5 hrs under a nitrogen stream. The ethylacetate was removed from the reactant to prepare a [crystalline resin 1] (crystalline polyester resin) having a melting point of 67° C.

<Crystalline Resin 2>

In a reaction vessel including a cooling pipe, a stirrer and a nitrogen inlet pipe, 310 parts of sebacic acid, 115 parts of 1,6-hexanediol, 65 parts of ethylene glycol and 1 part of titaniumdihydroxybis(triethanolaminate) as a condensation catalyst were reacted for 5 hrs under a nitrogen stream at 160° C. while produced water is removed, and further reacted for 3 hrs at 180° C. Next, the reactant was reacted for 4 hrs while gradually heated to have a temperature of 220° C. under a nitrogen stream and produced water, 1,6-hexanediol and ethylene glycol were removed. The reactant was further reacted under reduced pressure by 5 to 20 mm Hg until the reactant had a number-average molecular weight of 5,900 to prepare a base resin.

Meanwhile, in a reaction vessel including a cooling pipe, a stirrer and a nitrogen inlet pipe, 6.0 parts of 4,4-diphenylmethanediisocyanate (MDI), 75 parts of ethylacetate, and further the base resin solution were placed to be reacted at 80° C. for 5 hrs under a nitrogen stream. The ethylacetate was removed from the reactant to prepare a [crystalline resin 2] (crystalline polyester resin) having a melting point of 71° C.

<Crystalline Resin 3>

In a reaction vessel including a cooling pipe, a stirrer and a nitrogen inlet pipe, 260 parts of adipic acid, 255 parts of 1,6-hexanediol and 1 part of titaniumdihydroxybis(triethanolaminate) as a condensation catalyst were reacted for 8 hrs under a nitrogen stream at 180° C. while produced water is removed. Next, the reactant was reacted for 4 hrs while gradually heated to have a temperature of 220° C. under a nitrogen stream and produced water and 1,6-hexanediol were removed. The reactant was further reacted under reduced pressure by 5 to 20 mm Hg until the reactant had a number-average molecular weight of 5,000 to prepare a base resin. Two hundred (200) parts of ethylacetate were added to 250 parts of the base resin to be diluted at 60° C. to prepare a base resin solution.

Meanwhile, in a reaction vessel including a cooling pipe, a stirrer and a nitrogen inlet pipe, 8.3 parts of 4,4-diphenylmethanediisocyanate (MDI), 75 parts of ethylacetate, and further the base resin solution were placed to be reacted at 80° C. for 5 hrs under a nitrogen stream. The ethylacetate was removed from the reactant to prepare a [crystalline resin 3] (crystalline polyester resin) having a melting point of 59° C.

<Crystalline Resin 4>

In a reaction vessel including a cooling pipe, a stirrer and a nitrogen inlet pipe, 298 parts of sebacic acid, 195 parts of 1,4-butanediol and 1 part of titaniumdihydroxybis(triethanolaminate) as a condensation catalyst were reacted for 8 hrs under a nitrogen stream at 180° C. while produced water is removed. Next, the reactant was reacted for 4 hrs while gradually heated to have a temperature of 220° C. under a nitrogen stream and produced water and 1,4-butanediol were removed. The reactant was further reacted under reduced pressure by 5 to 20 mm Hg until the reactant had a number-average molecular weight of 5,700 to prepare a base resin. Two hundred (200) parts of ethylacetate were added to 250 parts of the base resin to be diluted at 60° C. to prepare a base resin solution.

Meanwhile, in a reaction vessel including a cooling pipe, a stirrer and a nitrogen inlet pipe, 6.7 parts of isophoronediisocyanate (IPDI), 75 parts of ethylacetate, and further the base resin solution were placed to be reacted at 80° C. for 5 hrs under a nitrogen stream. The ethylacetate was removed from the reactant to prepare a [crystalline resin 4] (crystalline polyester resin) having a melting point of 58° C.

<Crystalline Resin 5>

In a reaction vessel including a cooling pipe, a stirrer and a nitrogen inlet pipe, 210 parts of adipic acid, 235 parts of 1,10-decanediol and 1 part of titaniumdihydroxybis(triethanolaminate) as a condensation catalyst were reacted for 8 hrs under a nitrogen stream at 180° C. while produced water is removed. Next, the reactant was reacted for 4 hrs while gradually heated to have a temperature of 220° C. under a nitrogen stream and produced water was removed. The reactant was further reacted under reduced pressure by 5 to 20 mm Hg until the reactant had a number-average molecular weight of 5,100 to prepare a base resin. Two hundred (200) parts of ethylacetate were added to 250 parts of the base resin to be diluted at 60° C. to prepare a base resin solution.

Meanwhile, in a reaction vessel including a cooling pipe, a stirrer and a nitrogen inlet pipe, 8.5 parts of 4,4-diphenylmethanediisocyanate (MDI), 75 parts of ethylacetate, and further the base resin solution were placed to be reacted at 80° C. for 5 hrs under a nitrogen stream. The ethylacetate was removed from the reactant to prepare a [crystalline resin 5] (crystalline polyester resin) having a melting point of 67° C.

<Crystalline Resin 6>

In a reaction vessel including a cooling pipe, a stirrer and a nitrogen inlet pipe, 283 parts of sebacic acid, 215 parts of 1,6-hexanediol and 1 part of titaniumdihydroxybis(triethanolaminate) as a condensation catalyst were reacted for 8 hrs under a nitrogen stream at 180° C. while produced water is removed. Next, the reactant was reacted for 4 hrs while gradually heated to have a temperature of 220° C. under a nitrogen stream and produced water and 1,6-hexanediol were removed. The reactant was further reacted under reduced pressure by 5 to 20 mm Hg until the reactant had a number-average molecular weight of 17,000 to prepare a [crystalline resin 6] (crystalline polyester resin) having a melting point of 69° C.

<Crystalline Resin 7>

In a reaction vessel including a cooling pipe, a stirrer and a nitrogen inlet pipe, 283 parts of sebacic acid, 215 parts of 1,6-hexanediol and 1 part of titaniumdihydroxybis(triethanolaminate) as a condensation catalyst were reacted for 8 hrs under a nitrogen stream at 180° C. while produced water is removed. Next, the reactant was reacted for 4 hrs while gradually heated to have a temperature of 220° C. under a nitrogen stream and produced water and 1,6-hexanediol were removed. The reactant was further reacted under reduced pressure by 5 to 20 mm Hg until the reactant had a number-average molecular weight of 5,200 to prepare a base resin. Two hundred (200) parts of ethylacetate were added to 250 parts of the base resin to be diluted at 60° C. to prepare a base resin solution.

Meanwhile, in a reaction vessel including a cooling pipe, a stirrer and a nitrogen inlet pipe, 35 parts of 4,4-diphenylmethanediisocyanate (MDI), 30 parts of an adduct of bisphenol A with 2 moles of ethyleneoxide and 75 parts of ethylacetate, and further the base resin solution were placed to be reacted at 80° C. for 5 hrs under a nitrogen stream. The ethylacetate was removed from the reactant to prepare a [crystalline resin 7] (crystalline polyester resin) having a melting point of 65° C.

<Crystalline Resin Prepolymer>

In a reaction vessel including a cooling pipe, a stirrer and a nitrogen inlet pipe, 283 parts of sebacic acid, 215 parts of 1,6-hexanediol and 1 part of titaniumdihydroxybis(triethanolaminate) as a condensation catalyst were reacted for 8 hrs under a nitrogen stream at 180° C. while produced water is removed. Next, the reactant was reacted for 4 hrs while gradually heated to have a temperature of 220° C. under a nitrogen stream and produced water and 1,6-hexanediol were removed. The reactant was further reacted under reduced pressure by 5 to 20 mm Hg until the reactant had a number-average molecular weight of 5,000 to prepare a base resin. The base resin had a softening point of 72.2° C. when measured by an elevated flow tester and a maximum peak temperature of melting heat of 66.9° C. when measure by a differential scanning calorimeter (DSC9, and a ratio of the softening point to the maximum peak temperature of melting heat was 1.08. Two hundred (200) parts of ethylacetate were added to 250 parts of the base resin to be diluted at 60° C. to prepare a base resin solution.

Meanwhile, in a reaction vessel including a cooling pipe, a stirrer and a nitrogen inlet pipe, 37 parts of 4,4-diphenylmethanediisocyanate (MDI) and 87 parts of ethylacetate, and further the base resin solution were placed to be reacted at 80° C. for 5 hrs under a nitrogen stream to prepare an ethylacetate solution including a [crystalline resin prepolymer] (modified polyester resin) having an isocyanate group at the end in an amount of 50% by weight.

Zero point five (0.5) parts of n-dibutylamine were uniformly mixed with 10 parts of the prepolymer solution to destroy the isocyanate at the end thereof. The solvent and the remaining n-dibutylamine were removed from the prepolymer, and which included THF-solubles having a weight-average molecular weight of 45,700.

<Amorphous Resin 1>

In a reaction vessel including a cooling pipe, a stirrer and a nitrogen inlet pipe, 215 parts of an adduct of bisphenol A with 2 moles of propyleneoxide, 132 parts of an adduct of bisphenol A with 2 moles of ethyleneoxide, 126 parts terephthalic acid and 1.8 parts of tetrabutoxytitanate were reacted at 230° C. for 6 hrs under a nitrogen stream while produced water was removed from the reactant. Next, after the reactant was reacted weight-average molecular weight for 1 hr and cooled to have a temperature of 180° C., 8 parts of trimellitic acid anhydride were added thereto and the reactant was reacted weight-average molecular weight until having a weight-average molecular weight about 10,000 to prepare an [amorphous resin 1] (amorphous polyester resin).

<Amorphous Resin Prepolymer>

Six eighty-two (682) parts of an adduct of bisphenol A with 2 moles of ethyleneoxide, 81 parts of an adduct of bisphenol A with 2 moles of propyleneoxide, 283 parts terephthalic acid, 22 parts of trimellitic acid anhydride and 2 parts of dibutyltinoxide were mixed and reacted in a reaction vessel including a cooling pipe, a stirrer and a nitrogen inlet pipe for 8 hrs at a normal pressure and 230° C. Further, after the mixture was depressurized to 10 to 15 mm Hg and reacted for 5 hrs to prepare an [intermediate polyester 1]. The [intermediate polyester 1] had a number-average molecular weight of 2,100, a weight-average molecular weight of 9,500, a Tg of 55° C. and an acid value of 0.5 mg KOH/g, a hydroxyl value of 49 mg KOH/g, a softening point of 92° C. when measured by an elevated flow tester, a maxim peak temperature of melting heat of 58° C. when measured by a DSC, and a ratio thereof (softening point/maxim peak temperature of melting heat) was 1.58.

Next, 411 parts of the [intermediate polyester 1-1], 89 parts of isophoronediisocyanate and 500 parts of ethyl acetate were reacted in a reaction vessel including a cooling pipe, a stirrer and a nitrogen inlet pipe for 5 hrs at 100° C. to prepare an [prepolymer 1]. The [prepolymer 1] included a free isocyanate in an amount of 1.53% by weight.

Zero point five (0.5) parts of n-dibutylamine were uniformly mixed with 10 parts of the prepolymer solution to destroy the isocyanate at the end thereof. The solvent and the remaining n-dibutylamine were removed from the prepolymer, and which included THF-solubles having a weight-average molecular weight of 51,300.

The softening point when measured by an elevated flow tester and the maxim peak temperature of melting heat when measured by a DSC of each of the resins are as follows.

TABLE 1

| | Softening point (° C.) | Peak temperature (° C.) | Ratio | Weight-average molecular weight |
|---|---|---|---|---|
| Crystalline resin 1 | 76 | 67 | 1.13 | 34,100 |
| Crystalline resin 2 | 83 | 70 | 1.19 | 35,500 |
| Crystalline resin 3 | 66 | 58 | 1.14 | 31,100 |
| Crystalline resin 4 | 64 | 58 | 1.11 | 36,700 |
| Crystalline resin 5 | 77 | 67 | 1.15 | 31,900 |
| Crystalline resin 6 | 73 | 69 | 1.07 | 35,800 |
| Crystalline resin 7 | 83 | 65 | 1.28 | 32,400 |
| Amorphous resin 1 | 95 | 52 | 1.83 | 9,800 |

Softening point: measured by an elevated flow tester
Peak temperature: of melting heat when measured by a DSC
Ratio: (softening point/maxim peak temperature of melting heat)

<Preparation of Colorant Dispersion 1>

Twenty (20) parts of copper phthalocyanine, 4 parts of a colorant dispersant (SOLSPERSE 28000 from Avecia Inc.) and 76 parts of ethylacetate were placed in a beaker, and mixed and uniformly dispersed. Then, the copper phthalocyanine was finely dispersed by a beads mill to prepare a [colorant dispersion 1]. The [colorant dispersion 1] was measured by LA-920 from HORIBA, Ltd. to find a volume-average particle diameter thereof was 0.3 μm.

<Preparation of Wax Dispersion>

In a reaction vessel including a cooling pipe, a thermometer and a stirrer, 15 parts of a paraffin wax HNP-9 (having a melting point of 75° C. from Nippon Seiro Co., Ltd.) and 85 parts of ethylacetate were placed. The mixture was heated to have a temperature of 78° C. so that the wax was fully dissolved and cooled to have a temperature of 30° C. for 1 hr while stirred. The mixture was further wet-pulverized by a beads mill (Ultra Visco Mill from IMECS CO., LTD.) for 6 passes under the following conditions:

liquid feeding speed of 1.0 kg/hr; peripheral disc speed of 10 m/sec; and filling zirconia beads having diameter of 0.5 mm for 80% by volume.

Finally, ethylacetate was added thereto to have a solid concentration of 15%. Thus, a [wax dispersion] was prepared.

<Preparation of Resin Solution>

In a reaction vessel including a thermometer and a stirrer, 100 parts of the [crystalline resin 1] and 100 parts of ethylacetate were placed, and the mixture was heated to have a temperature of 50° C. and uniformly stirred to prepare a [resin solution 1].

Example 1

In a beaker, 45 parts of the [resin solution 1], 15 parts of the [crystalline prepolymer 1], 14 part of the [wax dispersion 1], 10 parts of the [colorant dispersion 1] and 0.15 parts of the [lactone compound 1] were placed, and the mixture was stirred by a T. K. HOMO MIXER at 50° C. and 8,000 rpm to be uniformly dissolved and dispersed to prepare a [toner material liquid 1].

In a beaker, 99 parts of ion-exchanged water, 6 parts an aqueous dispersion including an organic particulate resin (a copolymer of styrene-methacrylate-butylacrylate-sodium salt of a sulfate ester with an adduct of ethylene oxide methacrylate for stabilizing dispersion) in an amount of 25% by weight, 1 part of carboxymethylcellulose sodium, and 10 parts sodium dodecyldiphenyletherdisulfonate having a concentration of 48.5% (ELEMINOL MON-7 from Sanyo Chemical Industries, Ltd.) were uniformly dissolved.

Next, 75 parts of the [toner material liquid 1] were placed in the solution while stirred at 10,000 rpm and 50° C., and the solution was stirred for 2 min.

Next, the mixture was transferred into a flask including a stirring bar and a thermometer, and ethylacetate was removed to have a concentration of 0.5% at 55° C. to prepare an [aqueous resin particle dispersion 1].

Next, as a pre-washing process, the [aqueous resin particle dispersion 1] was cooled to have room temperature and filtered. Three hundred (300) parts of ion-exchanged water were added to the resultant filtered cake and mixed by a T. K. HOMO MIXER at 12,000 rpm for 10 min, and filtered. This operation was performed twice.

Further, 300 parts of ion-exchanged water were added to the resultant filtered cake and mixed by a T. K. HOMO MIXER at 12,000 rpm for 10 min, and filtered. This operation was performed three times. Three hundred (300) parts of hydrochloric acid including a solid content of 1% by weight were added to the resultant filtered cake and mixed by a T. K. HOMO MIXER at 12,000 rpm for 10 min, and filtered. Finally, 300 parts of ion-exchanged water were added to the resultant filtered cake and mixed by a T. K. HOMO MIXER at 12,000 rpm for 10 min, and filtered. This operation was performed twice to prepare a filtered cake.

The resultant cake was pulverized and dried at 40° C. for 22 hrs to prepare a [resin particle 1] having a volume-average particle diameter of 5.6 μm.

One hundred (100) parts of the [resin particle 1] and 1.0 part of hydrophobic silica (H2000 from Clariant (Japan) K.K.) as an external additive were mixed by HENSCHEL MIXER from Mitsui Mining Co., Ltd. at a peripheral speed of 30 m/sec for 30 sec, and paused for 1 min, which was repeated for 5 times. Then, the particles were sieved by a mesh having an opening of 35 μm to prepare a [toner 1].

Examples 2 to 5

The procedure for preparation of the [toner 1] in Example 1 was repeated to prepare [toners 2 to 5] except for replacing the crystalline resin 1 with the crystalline resins 2 to 5 and lactone compound 1 with the lactone compounds 2 to 5, respectively.

Example 6

The procedure for preparation of the [toner 1] in Example 1 was repeated to prepare [toner 6] except for replacing the crystalline resin 1 with the crystalline resin 6.

Example 7

The procedure for preparation of the [toner 1] in Example 1 was repeated to prepare [toner 7] except for changing the weight of the lactone compound 1 from 0.15 to 0.30 parts.

Example 8

The procedure for preparation of the [toner 1] in Example 1 was repeated to prepare [toner 8] except for changing the weight of the lactone compound 1 from 0.15 to 0.06 parts.

Example 9

The procedure for preparation of the [toner 1] in Example 1 was repeated to prepare [toner 9] except for replacing the lactone compound 1 with the lactone compound 3.

Example 10

The procedure for preparation of the [toner 1] in Example 1 was repeated to prepare [toner 10] except for replacing the crystalline resin 1 with the crystalline resin 7.

Example 11

In a reaction vessel including a thermometer and a stirrer, 100 parts of the [crystalline resin 1] and 100 parts of ethylacetate were placed, and the mixture was heated to have a temperature of 50° C. and uniformly stirred to prepare a [resin solution 11].

In a beaker, 40 parts of the [resin solution 11], 5 parts of the [resin solution 1], 15 parts of the [crystalline prepolymer 1], 14 parts of the [wax dispersion 1], 10 parts of the [colorant dispersion 1] and 0.15 parts of the [lactone compound 1] were placed, and the mixture was stirred by a T. K. HOMO MIXER at 50° C. and 8,000 rpm to be uniformly dissolved and dispersed to prepare a [toner material liquid 11]. Since then, the procedure in Example 1 was repeated to prepare a [toner 11].

Example 12

The procedure for preparation of the [toner 1] in Example 1 was repeated to prepare [toner 12] except for replacing the [lactone compound 1] with a lactone compound 6 (15-pentadecanolactone from Tokyo Chemical Industries, Co., Ltd.).

Example 13

The procedure for preparation of the [toner 1] in Example 1 was repeated to prepare [toner 13] except for replacing the lactone compound 1 with the lactone compound 7.

Example 14

In a reaction vessel including a stirrer, a Dean-Stark pipe and a drip funnel, 100 parts of methyl ethyl ketone and 100 parts of isophorone diamine were stirred in a nitrogen atmosphere. The mixture was refluxed for 5 hrs while produced water was removed and cooled to prepare a ketimine compound solution in which an amino group of isophoronediamine was capped by methyl ethyl ketone.

In a beaker, 45 parts of the [resin solution 1], 15 parts of the [crystalline prepolymer 1], 14 parts of the [wax dispersion 1], 10 parts of the [colorant dispersion 1], 0.3 parts of the ketimine compound solution and 0.15 parts of the [lactone compound 1] were placed, and the mixture was stirred by a T. K. HOMO MIXER at 50° C. and 8,000 rpm to be uniformly dissolved and dispersed to prepare a [toner material liquid 14].

In a beaker, 99 parts of ion-exchanged water, 6 parts an aqueous dispersion including an organic particulate resin (a copolymer of styrene-methacrylate-butylacrylate-sodium salt of a sulfate ester with an adduct of ethylene oxide methacrylate for stabilizing dispersion) in an amount of 25% by weight, 1 part of carboxymethylcellulose sodium, and 9.5 parts sodium dodecyldiphenyletherdisulfonate having a concentration of 48.5% (ELEMINOL MON-7 from Sanyo Chemical Industries, Ltd.) were uniformly dissolved.

Next, 75 parts of the [toner material liquid 14] were placed in the solution while stirred at 10,000 rpm and 50° C., and the solution was stirred for 2 min.

Next, the mixture was transferred into a flask including a stirring bar and a thermometer, and ethylacetate was removed to have a concentration of 0.5% at 55° C. to prepare an [aqueous resin particle dispersion 14].

Next, as a pre-washing process, the [aqueous resin particle dispersion 14] was cooled to have room temperature and filtered. Three hundred (300) parts of ion-exchanged water were added to the resultant filtered cake and mixed by a T. K. HOMO MIXER at 12,000 rpm for 10 min, and filtered. This operation was performed twice.

Further, 300 parts of ion-exchanged water were added to the resultant filtered cake and mixed by a T. K. HOMO MIXER at 12,000 rpm for 10 min, and filtered. This operation was performed three times. Three hundred (300) parts of hydrochloric acid including a solid content of 1% by weight were added to the resultant filtered cake and mixed by a T. K. HOMO MIXER at 12,000 rpm for 10 min, and filtered. Finally, 300 parts of ion-exchanged water were added to the resultant filtered cake and mixed by a T. K. HOMO MIXER at 12,000 rpm for 10 min, and filtered. This operation was performed twice to prepare a filtered cake.

The resultant cake was pulverized and dried at 40° C. for 22 hrs to prepare a [resin particle 14] having a volume-average particle diameter of 5.6 μm.

One hundred (100) parts of the [resin particle 1] and 1.0 part of hydrophobic silica (H2000 from Clariant (Japan) K.K.) as an external additive were mixed by HENSCHEL MIXER from Mitsui Mining Co., Ltd. at a peripheral speed of 30 m/sec for 30 sec, and paused for 1 min, which was repeated for 5 times. Then, the particles were sieved by a mesh having an opening of 35 μm to prepare a [toner 14].

Example 15

<Preparation of Crystalline Resin Latex 1 >

Thirty-nine (39) g of the [crystalline resin 1] and 1 g of the [lactone compound 1] were kneaded at 80° C., cooled and added to 360 g of ion-exchanged water. The mixture was heated to have a temperature of 90° C. and a pH of 7.5 with an aqueous solution of sodium hydrate having a concentration of 4%. The mixture was stirred by ULTRA TURRAX T50 from IKA at 8.000 rpm while 0.8 g of an aqueous solution of dodecylbenzenesulfonate having a concentration of 10% was added thereto to prepare a [crystalline resin latex 1] having a central diameter of 320 nm. The latex had a solid content concentration of 11%.

<Preparation of Crystalline Resin Latex 2>

One point one (1.1) g of an aqueous solution of dodecylbenzenesulfonate having a concentration of 10% was added to 360 g of ion-exchanged water, and an aqueous solution of sodium hydrate having a concentration of 4% was further added thereto to prepare an aqueous phase having a pH of 9.0. The aqueous phase was heated to have a temperature of 55° C. Next, 80 g of the [crystalline prepolymer 1] was heated to have a temperature of 55° C. to be fluid and placed in the aqueous phase. The mixture was stirred by ULTRA TURRAX T50 from IKA at 8.000 rpm for 10 min and ethylacetate was removed to have a concentration of 0.5% to prepare a [crystalline resin latex 2] having a central diameter of 350 nm. The latex had a solid content concentration of 10%.

<Preparation of Cyan Pigment Dispersion B-1>

The following compositions were mixed and dissolved, and dispersed by a homogenizer (IKA ULTRA TURRAX) and an ultrasonic irradiation to prepare a [cyan pigment dispersion B-1] having a central diameter of 150 nm.

| | |
|---|---|
| Cyan pigment C.I. Pigment Blue 15:3 (Copper phthalocyanine from Dainippon Ink And Chemicals, Inc.) | 50 g |
| Anionic surfactant Neogen SC | 5 g |
| Ion-exchanged water | 200 g |

<Preparation of Release Agent Dispersion C-1>

The following compositions were mixed and heated to have a temperature of 97° C., and dispersed by ULTRA TURRAX T50 from IKA. Then, the mixture was dispersed by a golin homogenizer from MEIWAFOSIS CO., LTD. under the conditions of 105° C. and 550 kg/cm$^2$ for 20 times to prepare a [release agent dispersion C-1] having a central diameter of 190 nm.

| | |
|---|---|
| Paraffin wax (HNP-9 from Nippon Seiro Co.) | 100 g |
| Anionic surfactant Neogen SC | 5 g |
| Ion-exchanged water | 300 g |
| Crystalline resin latex 1 | 260 |
| Crystalline resin latex 2 | 120 |
| Cyan pigment dispersion B-1 | 10 |
| Release agent dispersion C-1 | 8 |
| Polyaluminum chloride | 0.15 |
| Ion-exchanged water | 400 |

The above-mentioned compositions were fully mixed and dispersed by a homogenizer ULTRA TURRAX T50 from IKA in a round stainless flask. The flask was heated to have a temperature of 48° C. in a heating oil bath while stirred to agglutinate particles. When the particle diameter was 5.7 μm, the mixture was adjusted to have a pH of 6.0 with an aqueous solution of sodium hydrate of 0.5 mol/l and heated to have a temperature of 70° C. while stirred. The mixture decreased pH to 5.6 while heated to have a temperature of 70° C., but which was maintained. When the particles have a circularity of 0.970, the mixture was cooled to prepare an [aqueous resin particle dispersion 15].

Next, as a pre-washing process, after the [aqueous resin particle dispersion 15] was cooled to have room temperature and filtered, 300 parts of ion-exchanged water were added to the resultant filtered cake and mixed by a T. K. HOMO MIXER at 12,000 rpm for 10 min, and filtered. This operation was performed twice.

Further, 300 parts of ion-exchanged water were added to the resultant filtered cake and mixed by a T. K. HOMO MIXER at 12,000 rpm for 10 min, and filtered. This operation was performed three times. Three hundred (300) parts of hydrochloric acid including a solid content of 1% by weight were added to the resultant filtered cake and mixed by a T. K. HOMO MIXER at 12,000 rpm for 10 min, and filtered. Finally, 300 parts of ion-exchanged water were added to the resultant filtered cake and mixed by a T. K. HOMO MIXER at 12,000 rpm for 10 min, and filtered. This operation was performed twice to prepare a filtered cake.

The resultant cake was pulverized and dried at 40° C. for 22 hrs to prepare a [resin particle 15] having a volume-average particle diameter of 5.6 μm.

One hundred (100) parts of the [resin particle 15] and 1.0 part of hydrophobic silica (H2000 from Clariant (Japan) K.K.) as an external additive were mixed by HENSCHEL MIXER from Mitsui Mining Co., Ltd. at a peripheral speed of 30 m/sec for 30 sec, and paused for 1 min, which was repeated for 5 times. Then, the particles were sieved by a mesh having an opening of 35 μm to prepare a [toner 15].

Comparative Example 1

The procedure for preparation of the [toner 1] in Example 1 was repeated to prepare [toner 101] except for not adding the [lactone compound 1].

Comparative Examples 2 and 3

The procedure for preparation of the [toner 1] in Example 1 was repeated to prepare a [toner 102] and a [toner 103] except for replacing the [lactone compound 1] with ε-caprolactone 101 from Wako Pure Chemical Industries, Ltd. and L-lactide 102 from Wako Pure Chemical Industries, Ltd., respectively.

Comparative Example 4

The procedure for preparation of the [toner 1] in Example 1 was repeated to prepare [toner 104] except for replacing the [lactone compound 1] with stearic acid amide 103.

Comparative Example 5

The procedure for preparation of the [toner 1] in Example 1 was repeated to prepare [toner 105] except for replacing the [crystalline resin 1] with the [amorphous resin 1] and the crystalline resin prepolymer with the amorphous resin prepolymer.

Comparative Example 6

The procedure for preparation of the [toner 10] in Example 10 was repeated to prepare [toner 106] except for not adding the [lactone compound 1].

Evaluation Methods

<Fixability>

A copier MF-200 using a TEFLON roller (a registered trademark) as a fixing roller from Ricoh Company, Ltd., the fixer in which was modified was used to produce solid images having a toner adherence amount of 0.85±0.1 mg/cm$^2$ on receiving papers TYPE 6200 from Ricoh Company, Ltd. while the temperature of the fixing belt was increased at a unit of 5° C. from 90° C.

A sapphire needle 125 μm was run on the solid image at a needle rotation diameter of 8 mm and a load of 1 g using a tracing tester AD-401 from Ueshima Seisakusho Co., Ltd. A scratch (trace) of the sapphire needle on the image was visually observed. A minimum temperature at which no scratch was observed was minimum fixable temperature (MFT). In addition, the glossiness of the image increased as the fixing temperature increased, but began to decrease at a specific temperature.

<Image Strength> (IS)

An image was fixed on the above-mentioned paper by a fixing belt having a temperature of 160° C. According to JIS K5600-5-4, the image was scratched with a pencil having a hardness B.

Excellent: No scratch and the image was not damaged even when scraped with a rubber eraser Good: No scratch and the image was slightly damaged when scraped with a rubber eraser Fair: Almost no scratch, but the image was apparently damaged when scraped with a rubber eraser Poor: Scratches are observed, and the image was apparently damaged even when not scraped with a rubber eraser <Agglutination> (AG)

Seven (7) g of the toner and 93 g of a carrier used in imagio MP C4500 from Ricoh Company, Ltd. were mixed by a paint shaker for 2 min, and agglutination of the toner was observed by an SEM at a magnification of 1,000 times.

Excellent: No agglutination

Good: 1 to 2 agglutinations

Average: 3 to 5 agglutinations

Fair: 6 to 10 agglutinations

Poor: 11 or more agglutinations

It is preferable there is no agglutination, but developer having 5 or less agglutinations can be used without problem.

<Toner Surfaceness>

The surface of the resin particle was observed by an SEM at a magnification of 20,000 times. Compared with the toner 101 of Comparative Example 1, when a material different from a resin is seen exposed on the surface of the toner, the table says "observed". The exposed material (EM) causes toner agglutination and impairs fixability thereof.

The results are shown in Tables 2-1 to 2-3.

TABLE 2-1

| | Main Resin Material Composition | | | |
|---|---|---|---|---|
| | Resin 1 | Resin 2 | Resin 3 | X(%) |
| Example 1 | Crystalline resin 1 | | CR prepolymer | 92 |
| Example 2 | Crystalline resin 2 | | CR prepolymer | 92 |
| Example 3 | Crystalline resin 3 | | CR prepolymer | 92 |
| Example 4 | Crystalline resin 4 | | CR prepolymer | 92 |
| Example 5 | Crystalline resin 5 | | CR prepolymer | 92 |
| Example 6 | Crystalline resin 6 | | CR prepolymer | 92 |
| Example 7 | Crystalline resin 1 | | CR prepolymer | 91 |
| Example 8 | Crystalline resin 1 | | CR prepolymer | 92 |
| Example 9 | Crystalline resin 1 | | CR prepolymer | 92 |
| Example 10 | Crystalline resin 7 | | CR prepolymer | 92 |
| Example 11 | Crystalline resin 1 | Amorphous resin 1 | AR prepolymer | 8 |
| Example 12 | Crystalline resin 1 | | CR prepolymer | 92 |
| Example 13 | Crystalline resin 1 | | CR prepolymer | 92 |
| Example 14 | Crystalline resin 1 | | CR prepolymer | 92 |
| Example 15 | Crystalline resin 1 | | CR prepolymer | 90 |
| Comparative Example 1 | Crystalline resin 1 | | CR prepolymer | 92 |
| Comparative Example 2 | Crystalline resin 1 | | CR prepolymer | 92 |
| Comparative Example 3 | Crystalline resin 1 | | CR prepolymer | 92 |
| Comparative Example 4 | Crystalline resin 1 | | CR prepolymer | 92 |
| Comparative Example 5 | Amorphous resin 1 | | AR prepolymer | 0 |
| Comparative Example 6 | Crystalline resin 7 | | CR prepolymer | 91 |

CR: Crystalline resin

AR: Amorphous resin

X(%): Content of resin having crystalline polyester unit in toner

TABLES 2-2

| | Additive | | |
|---|---|---|---|
| | No. | Number of membered ring | Content Y(%) |
| Example 1 | 1 | 18 | 0.46 |
| Example 2 | 2 | 14 | 0.46 |
| Example 3 | 3 | 14 | 0.46 |
| Example 4 | 4 | 16 | 0.46 |
| Example 5 | 5 | 14 | 0.46 |
| Example 6 | 1 | 18 | 0.46 |
| Example 7 | 1 | 18 | 0.92 |

TABLES 2-2-continued

| | Additive | | |
|---|---|---|---|
| | No. | Number of membered ring | Content Y(%) |
| Example 8 | 1 | 18 | 0.18 |
| Example 9 | 3 | 18 | 0.46 |
| Example 10 | 1 | 18 | 0.46 |
| Example 11 | 1 | 18 | 0.46 |
| Example 12 | 6 | 16 | 0.46 |
| Example 13 | 7 | 22 | 0.46 |
| Example 14 | 1 | 18 | 0.46 |
| Example 15 | 1 | 18 | 1.76 |
| Comparative Example 1 | — | — | — |
| Comparative Example 2 | 101 | 7 | 0.46 |
| Comparative Example 3 | 102 | 6 | 0.46 |
| Comparative Example 4 | 103 | — | 0.46 |
| Comparative Example 5 | 1 | 18 | 0.46 |
| Comparative Example 6 | — | — | — |

Content Y(%): A ratio of ring compound in toner

TABLE 2-3

| | Evaluation Result | | | |
|---|---|---|---|---|
| | MFT | AG | IS | SEM EM |
| Example 1 | 95 | Excellent | Excellent | None |
| Example 2 | 95 | Excellent | Excellent | None |
| Example 3 | 95 | Excellent | Excellent | None |
| Example 4 | 95 | Excellent | Excellent | None |
| Example 5 | 95 | Excellent | Good | None |
| Example 6 | 100 | Excellent | Excellent | None |
| Example 7 | 100 | Good | Excellent | None |
| Example 8 | 90 | Average | Good | None |
| Example 9 | 95 | Average | Good | None |
| Example 10 | 100 | Excellent | Excellent | None |
| Example 11 | 110 | Excellent | Excellent | None |
| Example 12 | 95 | Average | Good | None |
| Example 13 | 95 | Average | Fair | None |
| Example 14 | 95 | Excellent | Excellent | None |
| Example 15 | 105 | Average | Good | None |
| Comparative Example 1 | 95 | Fair | Poor | — |
| Comparative Example 2 | 95 | Poor | Poor | None |
| Comparative Example 3 | 95 | Poor | Poor | None |
| Comparative Example 4 | 120 | Fair | Poor | Observed |
| Comparative Example 5 | 130 | Average | Excellent | Observed |
| Comparative Example 6 | 110 | Fair | Excellent | None |

MFT: minimum fixable temperature

AG: agglutination

IS: image strength

SEM EM: SEM exposed material

Having now fully described the invention, it will be apparent to one of ordinary skill in the art that many changes and modifications can be made thereto without departing from the spirit and scope of the invention as set forth therein.

What is claimed is:

1. A toner, comprising:

a lactone compound having not less than 14-membered rings; and a resin comprising a crystalline polyester unit formed from polycondensation between a diol and a dicarboxylic acid;

wherein the lactone compound is present in the toner as a separate component from the resin.

2. The toner of claim 1, wherein the lactone compound having not less than 14-membered rings has the following formula:

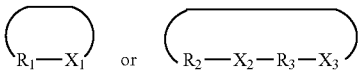

wherein $R_1$, $R_2$ and $R_3$ independently represent a bivalent saturated hydrocarbon linking group; and $X_1$, $X_2$ and $X_3$ independently represent an ester bonding site.

3. The toner of claim 1, wherein the lactone compound having not less than 14-membered rings has the following formula:

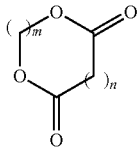

wherein m+n≥10, m≥2 and n≥2.

4. The toner of claim 1, wherein the resin comprising a crystalline polyester unit is a main component.

5. The toner of claim 1, wherein the resin comprising a crystalline polyester unit comprises an unmodified crystalline polyester resin.

6. The toner of claim 1, wherein the resin comprising a crystalline polyester unit comprises a modified crystalline polyester resin.

7. The toner of claim 6, wherein the modified crystalline polyester resin comprises a polyester resin having a urethane bond.

8. The toner of claim 7, wherein the polyester resin having a urethane bond is a block polymer formed of crystalline polyester and polyurethane.

9. The toner of claim 1, further comprising two or more of the resin comprising a crystalline polyester unit.

10. The toner of claim 1, which is obtained by granulating a toner material liquid in an aqueous medium.

11. A developer, comprising the toner according to claim 1.

12. An image forming apparatus, comprising:

an electrostatic latent image bearer configured to bear an electrostatic latent image;

a charger configured to charge the surface of the electrostatic latent image bearer;

an irradiator configured to irradiate the charged surface of the electrostatic latent image bearer to form an electrostatic latent image thereon;

an image developer configured to develop the electrostatic latent image with the toner according to claim 1 to form a visual image;

a transferer configured to transfer the visual image on a recording medium; and a fixer configured to fix the visual image on the recording medium.

13. The toner of claim 1, wherein the toner comprises the lactone compound in an amount from 0.05 to 5% by weight.

* * * * *